US009852828B2

(12) United States Patent
Gundel et al.

(10) Patent No.: US 9,852,828 B2
(45) Date of Patent: Dec. 26, 2017

(54) EDGE INSULATION STRUCTURE FOR ELECTRICAL CABLE

(71) Applicant: 3M INNOVATIVE PROPERTIES COMPANY, St. Paul, MN (US)

(72) Inventors: Douglas B. Gundel, Cedar Park, TX (US); Rocky D. Edwards, Lago Vista, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/786,292

(22) PCT Filed: Apr. 22, 2014

(86) PCT No.: PCT/US2014/034885

§ 371 (c)(1),
(2) Date: Oct. 22, 2015

(87) PCT Pub. No.: WO2014/179106

PCT Pub. Date: Nov. 6, 2014

(65) Prior Publication Data

US 2016/0078983 A1 Mar. 17, 2016

Related U.S. Application Data

(60) Provisional application No. 61/818,170, filed on May 1, 2013.

(51) Int. Cl.
*H01B 7/08* (2006.01)
*H01B 11/20* (2006.01)

(52) U.S. Cl.
CPC ..... *H01B 7/0823* (2013.01); *H01B 7/0861* (2013.01); *H01B 7/0869* (2013.01); *H01B 11/203* (2013.01); *H01B 7/0838* (2013.01)

(58) Field of Classification Search
USPC ..... 174/102 R, 117 F
See application file for complete search history.

(56) References Cited

U.S. PATENT DOCUMENTS 3,612,743 A 10/1971 Angele et al.
4,468,089 A 8/1984 Brorein
(Continued)

FOREIGN PATENT DOCUMENTS

EP 0 082 700 6/1983
EP 0 366 046 5/1990
(Continued)

OTHER PUBLICATIONS

PCT International Search Report from PCT/US2014/034885 mailed on Oct. 22, 2014, 9 pages.
(Continued)

*Primary Examiner* — William H Mayo, III
*Assistant Examiner* — Krystal Robinson
(74) *Attorney, Agent, or Firm* — Robert S. Moshrefzadeh

(57) ABSTRACT

A cable (2100) includes one or more conductor sets, one or more dielectric unitary blocks (2102) or reservoirs, first and second conductive shielding films (2108) disposed on opposite first and second sides of the conductor sets and the dielectric blocks (2102) or reservoirs, and an adhesive layer (2140). The shielding films (2108) include cover portions and pinched portions arranged such that, in cross-section, the cover portions of the shielding films in combination substantially surround each conductor set and each unitary block (2102) or reservoir, and the pinched portions of the shielding films in combination form pinched portions of the cable on each side of the conductor set and on at least one side of the unitary block (2102) or the reservoir. The adhesive layer (2140) bonds the first shielding film to the second shielding film in the pinched portions of the cable.

12 Claims, 28 Drawing Sheets

(56) References Cited

U.S. PATENT DOCUMENTS

| | | | | |
|---|---|---|---|---|
| 4,481,379 | A * | 11/1984 | Bolick, Jr. | H01B 7/0838 174/117 F |
| 5,025,115 | A * | 6/1991 | Sayegh | H01B 7/0838 174/117 F |
| 5,073,683 | A | 12/1991 | Anderson et al. | |
| 2002/0020545 | A1* | 2/2002 | Suzuki | H01B 7/0861 174/117 F |
| 2008/0185167 | A1* | 8/2008 | Lee | H01B 7/0823 174/117 F |
| 2012/0090866 | A1 | 4/2012 | Gundel | |
| 2012/0090872 | A1 | 4/2012 | Gundel | |
| 2012/0090873 | A1* | 4/2012 | Gundel | H01B 7/0861 174/113 R |
| 2012/0097421 | A1 | 4/2012 | Gundel | |
| 2013/0105196 | A1 | 5/2013 | Gundel et al. | |

FOREIGN PATENT DOCUMENTS

| | | |
|---|---|---|
| GB | 2 120 837 | 12/1983 |
| JP | H01-253122 | 10/1989 |
| JP | H05-36311 | 2/1993 |
| WO | WO 2012/030365 A1 | 3/2012 |

OTHER PUBLICATIONS

De Araujo, D.N. et al. "Full-Wave, TwinAx, Differential Cable Modeling", IEEE, 2008 Electronic Components and Technology Conference, pp. 1684-1689.

* cited by examiner

EDGE INSULATION STRUCTURE FOR ELECTRICAL CABLE

BACKGROUND

Electrical cables for transmission of electrical signals are known. One common type of electrical cable is a coaxial cable. Coaxial cables generally include an electrically conductive wire surrounded by an insulator. The wire and insulator are typically surrounded by a shield, and the wire, insulator, and shield are surrounded by a jacket. Another common type of electrical cable is a shielded electrical cable comprising one or more insulated signal conductors surrounded by a shielding layer formed, for example, by a metal foil. To facilitate electrical connection of the shielding layer, a further un-insulated conductor is sometimes provided between the shielding layer and the insulation of the signal conductor or conductors.

SUMMARY

In at least one aspect, the present invention provides a cable including one or more conductor sets, one or more dielectric unitary blocks, first and second conductive shielding films disposed on opposite first and second sides of the conductor sets and the dielectric blocks, and an adhesive layer. Each conductor set extends along a length of the cable and includes one or more insulated conductors. Each insulated conductor includes a central conductor surrounded by a dielectric material. Each unitary block extends along the length of the cable. The first and second conductive shielding films include cover portions and pinched portions arranged such that, in cross-section, the cover portions of the first and second shielding films in combination substantially surround each conductor set and each unitary block, and the pinched portions of the first and second shielding films in combination form pinched portions of the cable on each side of the conductor set and on at least one side of the unitary block. The adhesive layer bonds the first shielding film to the second shielding film in the pinched portions of the cable.

In at least one aspect, the present invention provides a cable including one or more conductor sets, a dielectric unitary block, first and second conductive shielding films disposed on opposite first and second sides of the conductor sets and the unitary block, and an adhesive layer. Each conductor set extends along a length of the cable and includes one or more insulated conductors. Each insulated conductor includes a central conductor surrounded by a dielectric material. The dielectric unitary block is disposed along an edge of the cable and extends along the length of the cable and has a bilobal cross-section having a thinner middle portion disposed between thicker first and second lobes. The first and second conductive shielding films include cover portions and pinched portions arranged such that, in cross-section, the cover portions of the first and second shielding films in combination substantially surround each conductor set and the first lobe of the unitary block, and the pinched portions of the first and second shielding films in combination form pinched portions of the cable on each side of the conductor set and on a side of the first lobe opposite the second lobe, an edge of each of the first and second conductive shielding films being disposed in the thinner middle portion of the unitary block. The adhesive layer bonds the first shielding film to the second shielding film in the pinched portions of the cable, and the first and second shielding films to the first lobe of the unitary block.

In at least one aspect, the present invention provides a cable including one or more conductor sets, one or more reservoirs, first and second conductive shielding films disposed on opposite first and second sides of the conductor sets and the reservoirs, and an adhesive layer. Each conductor set extends along a length of the cable and includes one or more insulated conductors. Each insulated conductor includes a central conductor surrounded by a dielectric material. Each reservoir extends along the length of the cable and is filled with a first dielectric material. The first and second conductive shielding films include cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir. The adhesive layer bonds the first shielding film to the second shielding film in the pinched portions of the cable. The first and second shielding films include respective first and second conductive layers disposed on respective first and second substrates, the first and second conductive layers facing each other. In a cover portion corresponding to a reservoir, the first conductive layer, but not the first substrate, includes an opening extending along at least a portion of the length of the cable.

In at least one aspect, the present invention provides a cable including one or more conductor sets, one or more reservoirs, first and second conductive shielding films disposed on opposite first and second sides of the conductor sets and the reservoirs, and an adhesive layer. Each conductor set extends along a length of the cable and includes one or more insulated conductors. Each insulated conductor includes a central conductor surrounded by a dielectric material. Each reservoir extends along the length of the cable and is filled with a first dielectric material. The first and second conductive shielding films include cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir. The adhesive layer bonds the first shielding film to the second shielding film in the pinched portions of the cable. The first and second shielding films includes respective first and second conductive layers disposed on respective first and second substrates, the first and second conductive layers facing each other. In a cover portion corresponding to a reservoir, longitudinal edges of the first and second conductive layers are recessed relative to longitudinal edges of the first and second substrates.

The above summary of the present invention is not intended to describe each disclosed embodiment or every implementation of the present invention. The details of one or more embodiments of the present invention are set forth in the accompanying drawings and the detailed description below. Other features, objects, and advantages of the invention will be apparent from the detailed description and drawings, and from the claims.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Some types of electrical cable are not insulated along the longitudinal edges of the cables. In some cases, an electrical cable may include a conductive material disposed near a longitudinal edge of the cable. In some cases, the conductive material may be included to provide shielding. As the number and speed of interconnected devices increases, electrical cables that carry signals between such devices need to be smaller and capable of carrying higher speed signals without unacceptable interference or crosstalk. Shielding is used in some electrical cables to reduce interactions between signals carried by neighboring conductors. Many of the cables described herein have a generally flat configuration, and include conductor sets that extend along the length of the cable, as well as electrical shielding films disposed on opposite sides of the cable. Pinched portions of the shielding films between adjacent conductor sets help to electrically isolate the conductor sets from each other. However, such conductive material disposed near the edge, for example, shielding films, is susceptible to making electrical contact at the edge and causing an electrical short. Specifically, the cable edge can cause shorting when it is in electrical contact with a conductive surface with a voltage different from ground. It is therefore of interest to create a non-conductive edge on the cable. This disclosure is directed to various edge insulation structures applied to a cable edge to reduce the possibility of electrical shorts. The edge insulation structure can be generated when the cable is constructed, or at a later step. Besides preventing electrical shorts, the edge insulation structures may also prevent moisture from penetrating the cable. This disclosure is also directed to apparatus and methods for applying material to an edge of a film. The same apparatus and methods can be used to create an edge insulation structure.

In some implementations, electrical cables are trimmed to suitable width after they are made. The trimming may cause exposure of conductive material at some locations along the edge of the cable. In this situation, it is beneficial to apply insulation structures at those locations. In some cases, it is not necessary to apply insulation structures along the entire edge of an electrical cable. For example, in such cases, insulation structures may be applied to a number of locations on the edge of the cable such that the possibility of electrical shorts is reduced.

Figure 1:
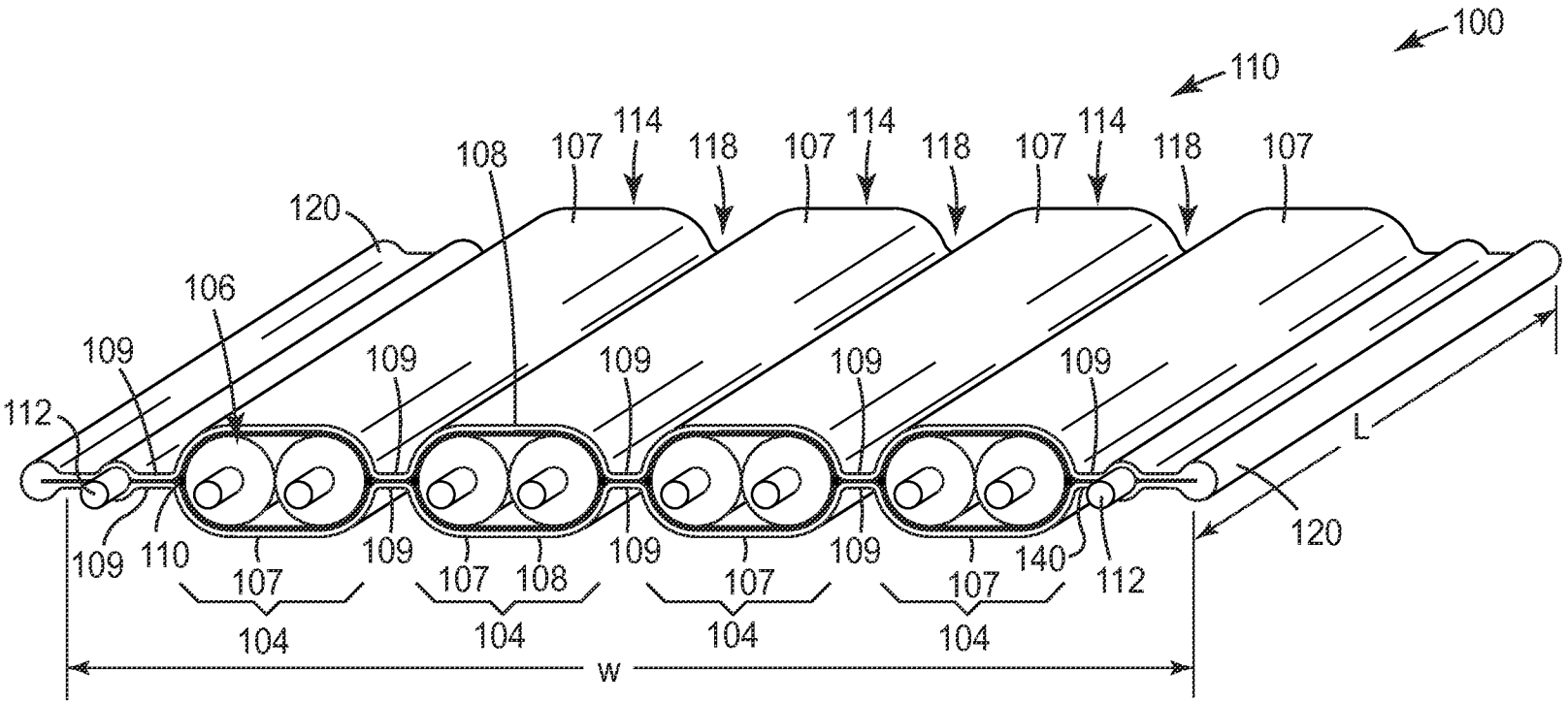
FIG. 1 illustrates an exemplary embodiment of an edge insulated electrical cable.

FIG. 1 illustrates an exemplary embodiment of an edge insulated electrical cable 100. The edge insulated electrical cable 100 includes an electrical cable 110 and an edge insulation structure 120 along the lengthwise edge of the cable 110. In some implementations, the edge insulation structure 120 can include an insulating material. The insulating material may be, for example, any types of dielectric materials. The dielectric material can be, for example, a UV curable material, a thermoplastic material, or the like.

In some embodiments, the edge insulation structure can be constructed to an essentially cylindrical shape, or referred to as edge bead herein. In some embodiments, the edge bead can be constructed by one of any classes of dielectric material that is flexible under certain condition, such that the dielectric material can be applied to the cable edge. For instance, the edge bead can be constructed by pressure sensitive adhesives, hot melt materials, thermoset materials, and curable materials. The pressure sensitive adhesives include those based on silicone polymers, acrylate polymers, natural rubber polymers, and synthetic rubber polymers. They may be tackified, crosslinked, and/or filled with various materials to provide desired properties. Hot melt materials become tacky and adhere well to substrates when they are heated above a specified temperature and/or pressure; when the adhesive cools down, its cohesive strength increases while retaining a good bond to the substrate. Examples of types of hot melt materials include, but are not limited to, polyamides, polyurethanes, copolymers of ethylene and vinyl acetate, and olefinic polymers modified with more polar species such as maleic anhydride. Thermoset materials are materials that can create an intimate contact with a substrate either at room temperature or with the application of heat and/or pressure. With heating, a chemical reaction occurs in the thermoset to provide long term cohesive strength at ambient, subambient, and elevated temperatures. Examples of thermoset materials include epoxies, silicones, and polyesters, and polyurethanes. Curable materials can include thermosets, but are differentiated here in that they can cure at room temperature, either with or without the addition of external chemical species or energy. Examples include two-part epoxies and polyesters, one-part moisture cure silicones and polyurethanes, and adhesives utilizing actinic radiation to cure such as UV, visible light, or electron beam energy.

In some embodiments, the edge insulation structure can be constructed by one or more layers of film covering the edge of the cable, referred to as edge film herein. In some implementations, the edge film can include a layer of polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. In some other implementations, the edge film can also include one or more additives and/or fillers to provide properties suitable for the intended application. The additives and fillers can be, for example, flame retardants, UV stabilizers, thermal stabilizers, anti-oxidants, lubricants, color pigments, or the like.

In some embodiments, the edge insulation structure 120 can include both a conductive material and an insulating material. The conductive material can be bonded to the electrical cable 110 while the insulating material can be applied over the conductive material. The insulation structure 120 may use material that is part of the cable's construction, for example, adhesive material that is used in the cable. In an exemplary embodiment, the electrical cable 110 includes one or more conductor sets 104, where each conductor set 104 includes one or more insulated conductors along the length of the electrical cable. In some embodiments, the edge insulation structure 120 may bond to a portion of the edge of the electrical cable 110, but not the entire edge, such that the possibility of electrical short is reduced.

The electrical cable 110 may include conductive material disposed near a location on a longitudinal edge of the cable that is susceptible to electrical contact at the location on the cable. For example, the conductive material can be shielding films 108 disposed across the cable potentially making electrical contact at or near the edge. In some embodiments, the electrical cable 110 includes a plurality of conductor sets 104 spaced apart from each other along all or a portion of a width, w, of the cable 110 and extend along a length, L, of the cable 110. The cable 110 may be arranged generally in a planar configuration as illustrated in FIG. 1 or may be folded at one or more places along its length into a folded configuration. In some implementations, some parts of cable 110 may be arranged in a planar configuration and other parts of the cable may be folded. In some configurations, at least one of the conductor sets 104 of the cable 110 includes two insulated conductors 106 extending along a length, L, of cable 110. The two insulated conductors 106 of the conductor sets 104 may be arranged substantially parallel along all or a portion of the length, L, of the cable 110. Insulated conductors 106 may include insulated signal wires, insulated power wires, or insulated ground wires. Two shielding films 108 are disposed on opposite sides of the cable 110.

The first and second shielding films 108 are arranged so that, in transverse cross section, cable 110 includes cover regions 114 and pinched regions 118. In the cover regions 114 of the cable 110, cover portions 107 of the first and second shielding films 108 in transverse cross section substantially surround each conductor set 104. For example, cover portions of the shielding films may collectively encompass at least 75%, or at least 80%, 85%, or 90% of the perimeter of any given conductor set. Pinched portions 109 of the first and second shielding films form the pinched regions 118 of cable 110 on each side of each conductor set 104. In the pinched regions 118 of the cable 110, one or both of the shielding films 108 are deflected, bringing the pinched portions 109 of the shielding films 108 into closer proximity. In some configurations, as illustrated in FIG. 1, both of the shielding films 108 are deflected in the pinched regions 118 to bring the pinched portions 109 into closer proximity. In some configurations, one of the shielding films may remain relatively flat in the pinched regions 118 when the cable is in a planar or unfolded configuration, and the other shielding film on the opposite side of the cable may be deflected to bring the pinched portions of the shielding film into closer proximity.

The cable 110 may also include an adhesive layer 140 disposed between shielding films 108 at least between the pinched portions 109. The adhesive layer 140 bonds the pinched portions 109 of the shielding films 108 to each other in the pinched regions 118 of the cable 110. The adhesive layer 140 may or may not be present in the cover region 114 of the cable 110.

In some cases, conductor sets 104 have a substantially curvilinearly-shaped envelope or perimeter in transverse cross-section, and shielding films 108 are disposed around conductor sets 104 such as to substantially conform to and maintain the cross-sectional shape along at least part of, and preferably along substantially all of, the length L of the cable 110. Maintaining the cross-sectional shape maintains the electrical characteristics of conductor sets 104 as intended in the design of conductor sets 104. This is an advantage over some conventional shielded electrical cables where disposing a conductive shield around a conductor set changes the cross-sectional shape of the conductor set.

Although in the embodiment illustrated in FIG. 1, each conductor set 104 has exactly two insulated conductors 106, in other embodiments, some or all of the conductor sets may include only one insulated conductor, or may include more than two insulated conductors 106. For example, an alternative shielded electrical cable similar in design to that of FIG. 1 may include one conductor set that has eight insulated conductors 106, or eight conductor sets each having only one insulated conductor 106. This flexibility in arrangements of conductor sets and insulated conductors allows the disclosed shielded electrical cables to be configured in ways that are suitable for a wide variety of intended applications. For example, the conductor sets and insulated conductors may be configured to form: a multiple twinaxial cable, i.e., multiple conductor sets each having two insulated conductors; a multiple coaxial cable, i.e., multiple conductor sets each having only one insulated conductor; or combinations thereof. In some embodiments, a conductor set may further include a conductive shield (not shown) disposed around the one or more insulated conductors, and an insulative jacket (not shown) disposed around the conductive shield.

In the embodiment illustrated in FIG. 1, shielded electrical cable 110 further includes optional ground conductors 112. Ground conductors 112 may include ground wires or drain wires. Ground conductors 112 can be spaced apart from and extend in substantially the same direction as insulated conductors 106. Shielding films 108 can be disposed around ground conductors 112. The adhesive layer 140 may bond shielding films 108 to each other in the pinched portions 109 on both sides of ground conductors 112. Ground conductors 112 may electrically contact at least one of the shielding films 108. Some exemplary electrical cable constructions are discussed in detail in U.S. Patent Publication No. 2012-0090873, entitled "Shielded Electrical Cable", and PCT Patent Publication No. WO 2012/030365, entitled "High Density Shielded Electrical Cable and Other Shielded Cables, Systems and Methods," which are incorporated herein by reference in entirety.

Figure 2:
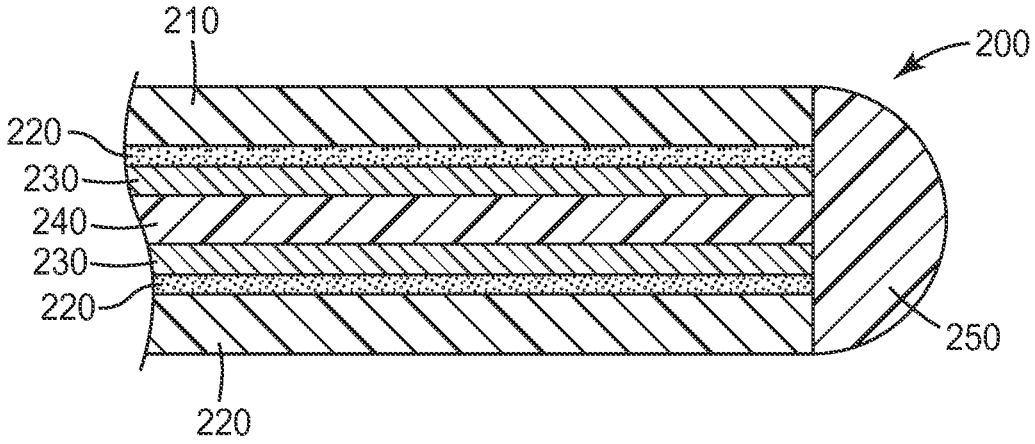
FIG. 2 is a cross-sectional view of an exemplary embodiment of an edge insulation structure.

FIG. 2 is a cross-sectional view of an exemplary embodiment of an edge insulation structure 200. In an exemplary embodiment, the edge insulation structure 200 includes an insulating material 250. Insulating material 250 can be any types of material providing insulation and capable of being bonded to a part of a cable close to the edge. For example, insulating material can form an edge insulation structure with bead-like shape. The insulating material 250 is bonded to the edge of the cable, where the cable includes layers of, for example, dielectric films 210, adhesive layers 220, shielding films 230 (i.e. metal), and dielectric layers 240 (i.e. hot melt adhesive).

The shielding films 230 can have a variety of configurations and be made in a variety of ways. In some cases, one or more shielding films may include a conductive layer and a non-conductive polymeric layer. The conductive layer may include any suitable conductive material, including but not limited to copper, silver, aluminum, gold, and alloys thereof. The non-conductive polymeric layer may include any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. The non-conductive polymeric layer may include one or more additives and/or fillers to provide properties suitable for the intended application. In some cases, at least one of the shielding films may include a laminating adhesive layer disposed between the conductive layer and the non-conductive polymeric layer. For shielding films that have a conductive layer disposed on a non-conductive layer, or that otherwise have one major exterior surface that is electrically conductive and an opposite major exterior surface that is substantially non-conductive, the shielding film may be incorporated into the shielded cable in several different orientations as desired. In some cases, for example, the conductive surface may face the conductor sets of insulated wires and ground wires, and in some cases the non-conductive surface may face those components. In cases where two shielding films are used on opposite sides of the cable, the films may be oriented such that their conductive surfaces face each other and each face the conductor sets and ground wires, or they may be oriented such that their non-conductive surfaces face each other and each face the conductor sets and ground wires, or they may be oriented such that the conductive surface of one shielding film faces the conductor sets and ground wires, while the non-conductive surface of the other shielding film faces conductor sets and ground wires from the other side of the cable.

In some cases, at least one of the shielding films may be or include a stand-alone conductive film, such as a compliant or flexible metal foil. The construction of the shielding films may be selected based on a number of design parameters suitable for the intended application, such as, e.g., flexibility, electrical performance, and configuration of the shielded electrical cable (such as, e.g., presence and location of ground conductors). In some cases, the shielding films may have an integrally formed construction. In some cases, the shielding films may have a thickness in the range of 0.01 mm to 0.05 mm. The shielding films desirably provide isolation, shielding, and precise spacing between the conductor sets, and allow for a more automated and lower cost cable manufacturing process. In addition, the shielding films prevent a phenomenon known as "signal suck-out" or resonance, whereby high signal attenuation occurs at a particular frequency range. This phenomenon typically occurs in conventional shielded electrical cables where a conductive shield is wrapped around a conductor set.

As discussed elsewhere herein, adhesive material may be used in the cable construction to bond one or two shielding films to one, some, or all of the conductor sets at cover regions of the cable, and/or adhesive material may be used to bond two shielding films together at pinched regions of the cable. A layer of adhesive material may be disposed on at least one shielding film, and in cases where two shielding films are used on opposite sides of the cable, a layer of adhesive material may be disposed on both shielding films. In the latter cases, the adhesive used on one shielding film is preferably the same as, but may if desired be different from, the adhesive used on the other shielding film. A given adhesive layer may include an electrically insulative adhesive, and may provide an insulative bond between two shielding films. Furthermore, a given adhesive layer may provide an insulative bond between at least one of shielding films and insulated conductors of one, some, or all of the conductor sets, and between at least one of shielding films and one, some, or all of the ground conductors (if any). Alternatively, a given adhesive layer may include an electrically conductive adhesive, and may provide a conductive bond between two shielding films. Furthermore, a given adhesive layer may provide a conductive bond between at least one of shielding films and one, some, or all of the ground conductors (if any). Suitable conductive adhesives include conductive particles to provide the flow of electrical current. The conductive particles can be any of the types of particles currently used, such as spheres, flakes, rods, cubes, amorphous, or other particle shapes. They may be solid or substantially solid particles such as carbon black, carbon fibers, nickel spheres, nickel coated copper spheres, metal-coated oxides, metal-coated polymer fibers, or other similar conductive particles. These conductive particles can be made from electrically insulating materials that are plated or coated with a conductive material such as silver, aluminum, nickel, or indium tin-oxide. The metal-coated insulating material can be substantially hollow particles such as hollow glass spheres, or may comprise solid materials such as glass beads or metal oxides. The conductive particles may be on the order of several tens of microns to nanometer sized materials such as carbon nanotubes. Suitable conductive adhesives may also include a conductive polymeric matrix.

When used in a given cable construction, an adhesive layer is preferably substantially conformable in shape relative to other elements of the cable, and conformable with regard to bending motions of the cable. In some cases, a given adhesive layer may be substantially continuous, e.g., extending along substantially the entire length and width of a given major surface of a given shielding film. In some cases, the adhesive layer may include be substantially discontinuous. For example, the adhesive layer may be present only in some portions along the length or width of a given shielding film. A discontinuous adhesive layer may for example include a plurality of longitudinal adhesive stripes that are disposed, e.g., between the pinched portions of the shielding films on both sides of each conductor set and between the shielding films beside the ground conductors (if any). A given adhesive material may be or include at least one of a pressure sensitive adhesive, a hot melt adhesive, a thermoset adhesive, and a curable adhesive. An adhesive layer may be configured to provide a bond between shielding films that is substantially stronger than a bond between one or more insulated conductor and the shielding films. This may be achieved, e.g., by appropriate selection of the adhesive formulation. An advantage of this adhesive configuration is to allow the shielding films to be readily strippable from the insulation of insulated conductors. In other cases, an adhesive layer may be configured to provide a bond between shielding films and a bond between one or more insulated conductor and the shielding films that are substantially equally strong. An advantage of this adhesive configuration is that the insulated conductors are anchored between the shielding films. When a shielded electrical cable having this construction is bent, this allows for little relative movement and therefore reduces the likelihood of buckling of the shielding films. Suitable bond strengths may be chosen based on the intended application. In some cases, a conformable adhesive layer may be used that has a thickness of less than about 0.13 mm. In exemplary embodiments, the adhesive layer has a thickness of less than about 0.05 mm.

A given adhesive layer may conform to achieve desired mechanical and electrical performance characteristics of the shielded electrical cable. For example, the adhesive layer may conform to be thinner between the shielding films in areas between conductor sets, which increases at least the lateral flexibility of the shielded cable. This may allow the shielded cable to be placed more easily into a curvilinear outer jacket. In some cases, an adhesive layer may conform to be thicker in areas immediately adjacent the conductor sets and substantially conform to the conductor sets. This may increase the mechanical strength and enable forming a curvilinear shape of shielding films in these areas, which may increase the durability of the shielded cable, for example, during flexing of the cable. In addition, this may help to maintain the position and spacing of the insulated conductors relative to the shielding films along the length of the shielded cable, which may result in more uniform impedance and superior signal integrity of the shielded cable.

A given adhesive layer may conform to effectively be partially or completely removed between the shielding films in areas between conductor sets, e.g., in pinched regions of the cable. As a result, the shielding films may electrically contact each other in these areas, which may increase the electrical performance of the cable. In some cases, an adhesive layer may conform to effectively be partially or completely removed between at least one of the shielding films and the ground conductors. As a result, the ground conductors may electrically contact at least one of shielding films in these areas, which may increase the electrical performance of the cable. Even in cases where a thin layer of adhesive remains between at least one of shielding films and a given ground conductor, asperities on the ground conductor may break through the thin adhesive layer to establish electrical contact as intended.

The edge insulation structure may take various forms, for example, edge beads, insulating films, and edge folding. FIGS. 3A-3E illustrate cross-section views of a number of exemplary embodiments of edge beads according to aspects of the present disclosure, including an electrical cable 300 and an edge bead 310. The cable 300 can include a plurality of layers. In some cases, one of the plurality of layers can be conductive. As used herein, an edge bead refers to an edge insulation structure with a lump at the edge. In some configurations, the lump at the edge may be essentially round at cross-section. In some configurations, the edge bead can include a portion bonded to the top and/or bottom surface of the cable to provide better support. The edge bead 310 includes one or more edge bead materials. The edge bead materials typically include dielectric material that is not rigid under certain conditions such that the dielectric material can be applied to the edge of the cable 300 conforming to the shape of the edge. In some embodiments, the edge bead materials include a thermoplastic or a curable compound, for example, a UV curable, 3-beam, or air curable compounds. In some cases, the edge bead materials can include adhesive material such that a dielectric material to the electrical cable 300 via the adhesive material. In some other cases, the edge bead material can include a coating material to provide protection to the insulation structure. In some implementations, a dielectric material is applied to the edge of the electrical cable in a liquid form (i.e., melt, solution, etc.). How to construct an edge bead is discussed further below.

Figure 3A:
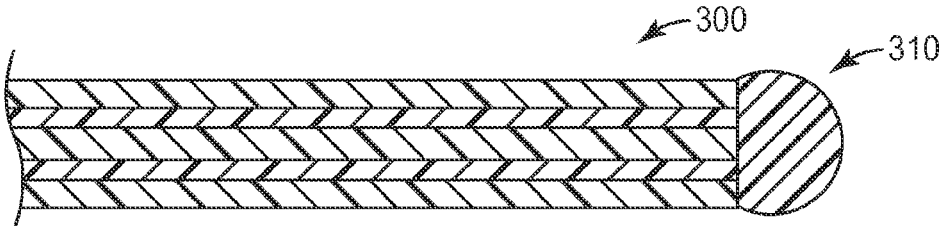
FIGS. 3A-3D illustrate a number of exemplary embodiments of edge beads.
Figure 3B:
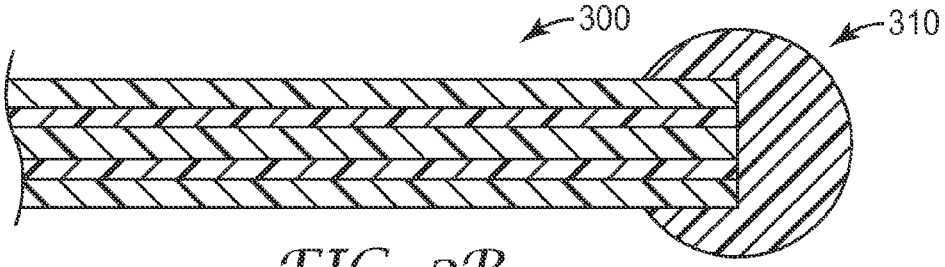
Figure 3C:
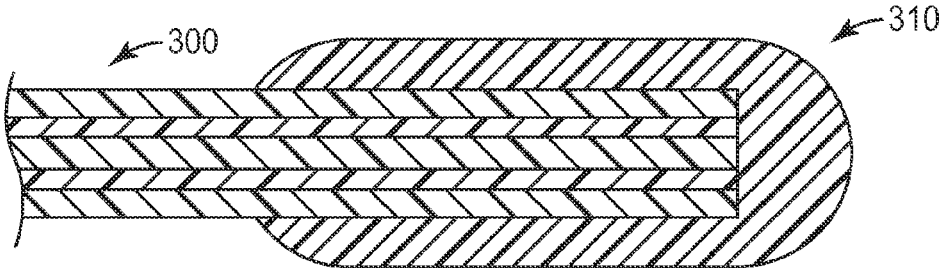
Figure 3D:
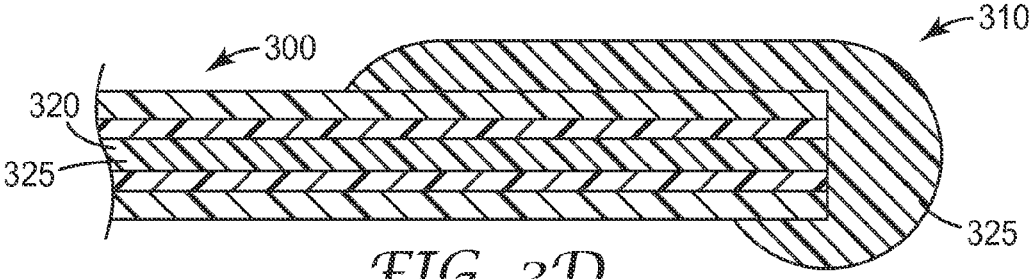

FIG. 3A illustrates an exemplary embodiment of edge bead 310 covering only the edge of a cable 300. The edge bead 310 may have a cross-section shape of, for example, a half-circle or a portion of circle, covering the edge. In some cases, stronger bonding of the edge bead 310 to the cable 300 can be obtained when the material applied to at least one of the top surface and bottom surface of the cable and the edge. FIG. 3B illustrates an exemplary embodiment of an edge bead 310 covering both the edge and a portion of top and bottom surface of the cable 300. In cross sectional view, the edge bead may be generally round. FIG. 3C illustrates another exemplary embodiment of an edge bead 310 that covers the edge and both portions of the top surface and bottom surface of the cable near the edge. In this embodiment, the edge bead 310 can have a width, which covers portions of the top surface and bottom surface, greater than its thickness. FIG. 3D illustrates a further exemplary embodiment of an edge bead 310 that covers more area on one surface than area on the opposing surface of the cable 300.

In some embodiments, the edge bead 310 can be formed, at least in part, by a dielectric material that is used in the electrical cable 300. As illustrated in FIG. 3D, the cable 300 can have a plurality of layers including a dielectric layer 320. The dielectric layer 320 can contain dielectric material 325. The dielectric material 325 may be, for example, thermoplastic or hot melt material, that is used to bond the shielding films (i.e. 230 in FIG. 2). In a particular embodiment, the dielectric material 325 may be adapted to transfer to another location in the cable when it is subjected to condition changes. For example, the dielectric material 325 may move to another location when it is under pressure. In another example, the dielectric material 325 may become flowable when it is heated. In some cases, the edge insulation structure may be formed by extruding the dielectric material 325 from near the edge to outside the edge. In some configurations, the dielectric material 325 is any class of adhesive materials that can be bonded to the electrical cable 300. The edge bead 310 can be formed by the dielectric material 325. In some other configurations, the edge portion of the electrical cable 300 is coated with adhesive material before the dielectric material 325 is extruded from the cable 300. In yet other configurations, after the dielectric material 325 is applied to the edge of the cable 300, another material can be applied on top of the dielectric material 325 to provide support and/or protection, for example, to cover the dielectric material 325.

Figure 4:
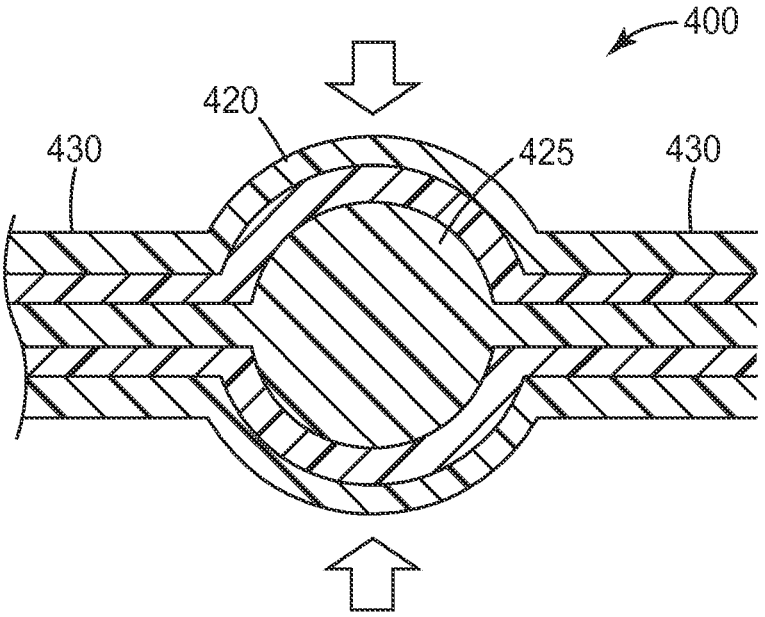
FIG. 4 is a cross-sectional view of an exemplary embodiment of an electrical cable having a reservoir extending lengthwise along the cable.

In some embodiments, an electrical cable may include a reservoir or a pocket extending lengthwise along the electrical cable at a first lateral location, as illustrated in FIG. 4. The reservoir may be configured to contain a dielectric material adapted to be transferred to a second lateral location in the cable that is different from the first lateral location in the cable. An edge insulation structure can be formed by the dielectric material being transferred to the outer edge of the cable. FIG. 4 is a cross-sectional view of an exemplary embodiment of an electrical cable 400 having a reservoir 420 extending lengthwise along the cable. The reservoir 420 may have a larger volume than its adjacent areas 430 along the widthwise in the cable. The reservoir 420 may store dielectric material 425 adapted to be transferred to a second location of the cable. In some configurations, the reservoir 420 can contain dielectric material 425 that is flowable under certain condition. For example, the dielectric material 425 can become flowable after heat is applied.

Figure 5:
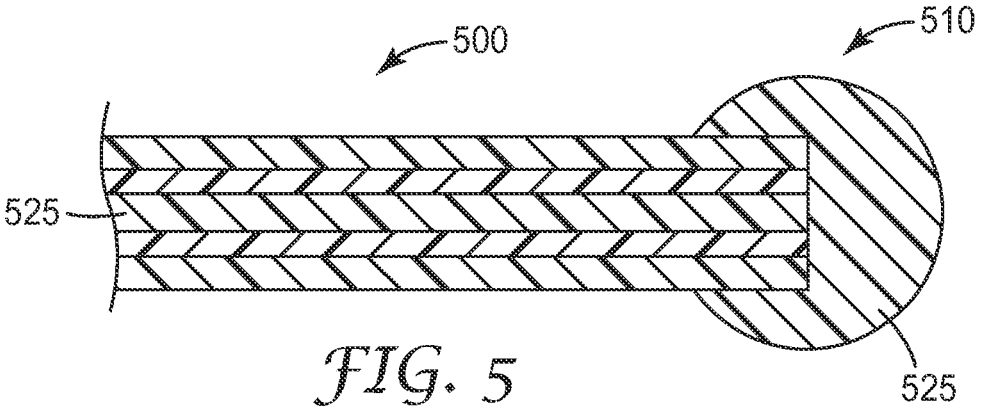
FIG. 5 illustrates an exemplary embodiment of an edge bead formed by the dielectric material disposed in the reservoir.

In some embodiments, the dielectric material can be transferred to a second lateral location when the reservoir is extruded, pressed, squeezed, or by other mechanical approaches. In some cases, the dielectric material can be transferred to a second lateral location when the reservoir is heated. The dielectric material in the reservoir can flow to the edge of the electrical cable to form an edge bead. FIG. 5 illustrates an exemplary embodiment of an edge bead 510 formed by the dielectric material 525 disposed in a reservoir 520 of an electrical cable 500. In some configurations, at least a portion of the longitudinal edge of the electrical cable 500 is coated with a layer of adhesive before the dielectric material 525 is extruded from the cable 500, for example, from the reservoir 420 as illustrated in FIG. 4.

FIGS. 6A-6E illustrate a number of exemplary embodiments of edge insulation structure in edge films. In some embodiments, these edge films are typically applied to regions near a longitudinal edge of an electrical cable. The edge films can be of any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. Additionally, the edge films can include one or more additives and/or fillers to provide properties suitable for the intended application.

Figure 6A:
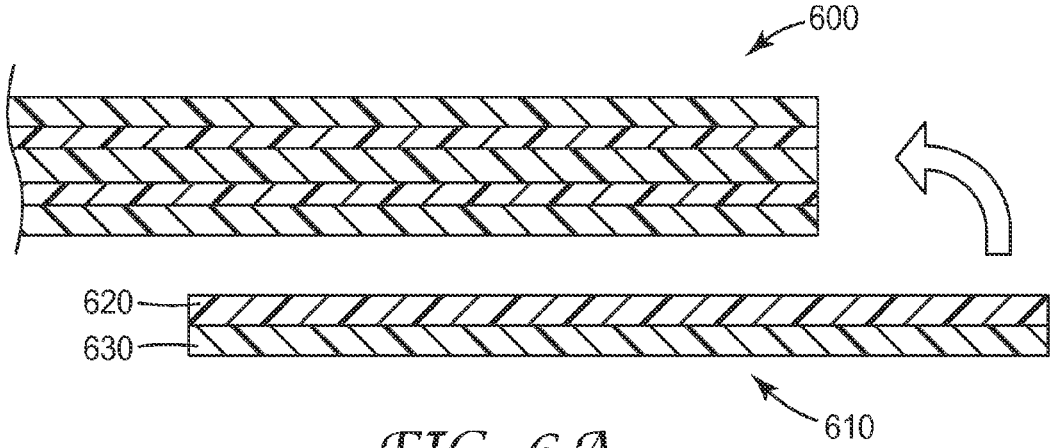
FIGS. 6A-6E illustrate a number of exemplary embodiments of edge insulation structure in edge films.
Figure 6B:
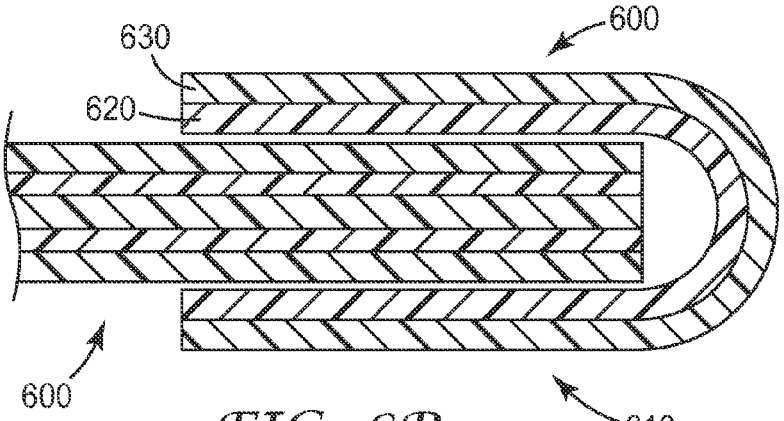

FIGS. 6A and 6B illustrate an embodiment of an edge film 610 folded around an electrical cable 600. In some other embodiments, the electrical cable 600 can have a plurality of layers including a conductive layer disposed at the edge of the electrical cable 600. Such conductive layer may increase possibility of electrical contact at the edge of the cable 600. The edge film 610 can include one or more layers of material. In an exemplary embodiment, the edge film 610 may include a layer of adhesive material 620 and a layer for backing 630. In another embodiment, the edge film 610 may include a single layer of material that is bonded to the cable 600. In yet another exemplary embodiment, the edge film 610 may include a conductive layer and a dielectric layer, where the conductive layer can provide shielding and the dielectric layer can reduce the possibility of electrical shorts. In further other exemplary embodiments, the edge film 610 can include a plurality of layers, for example, a conductive layer, a layer of dielectric material, and a layer of backing.

Figure 6C:
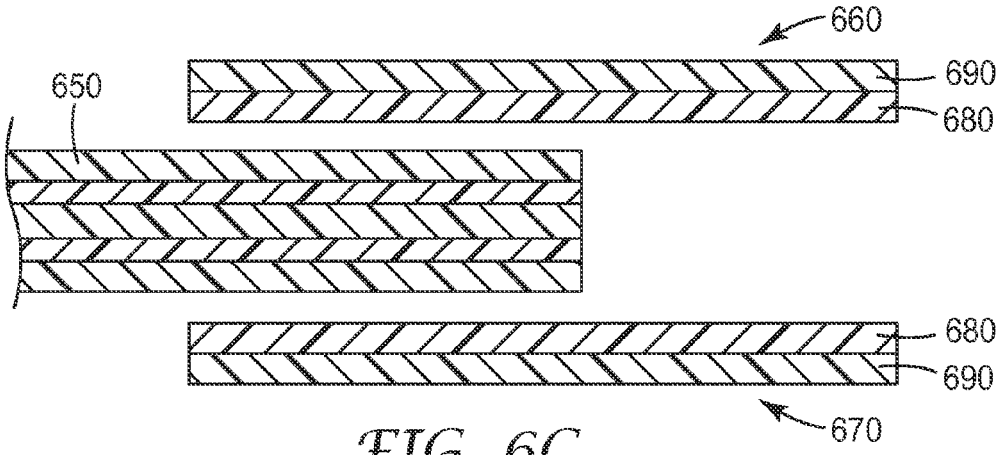
Figure 6D:
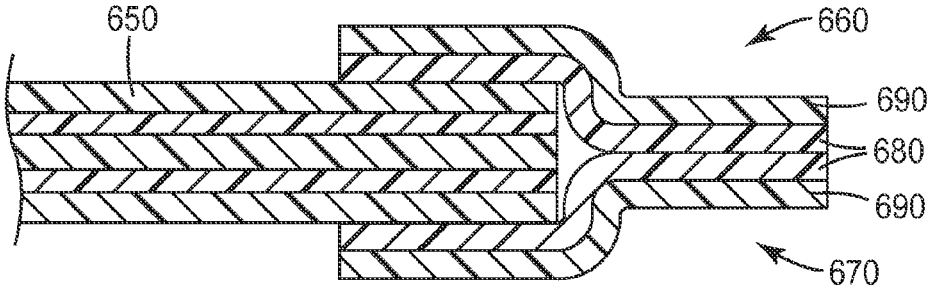

FIGS. 6C and 6D illustrate another embodiment of an edge insulated electrical cable 650 with edge film. An edge insulation structure is formed by an upper edge film 660 and a lower edge film 670 bonded together by, for example, any mechanical, adhesive, or chemical means. In an exemplary embodiment, the edge films 660 and 670 may include a layer of a layer for dielectric material 690. Optionally, at least one of the edge films 660 and 670 include a layer of adhesive material 680. In some cases, both the edge films 660 and 670 include a layer of adhesive material 680. In such configurations, the edge films 660 and 670 may be bonded together by adhesive layers 680. In some other cases, only one of the edge films includes the adhesive layer 680. For example, the upper edge film 660 includes the adhesive layer 680 and the lower edge film 670 does not include an adhesive layer. The upper edge film and a lower edge film 670 can be bonded by the adhesive layer 680. In another embodiment, the edge film 610 may include a single layer of dielectric material 690 that can be bonded to the cable 600. The single layer of material can be, for example, a layer of curable compound. In yet other cases, the edge films 660 and 670 can include a plurality of layers, for example, a conductive layer, a layer of dielectric material, and a layer of backing.

Figure 6E:
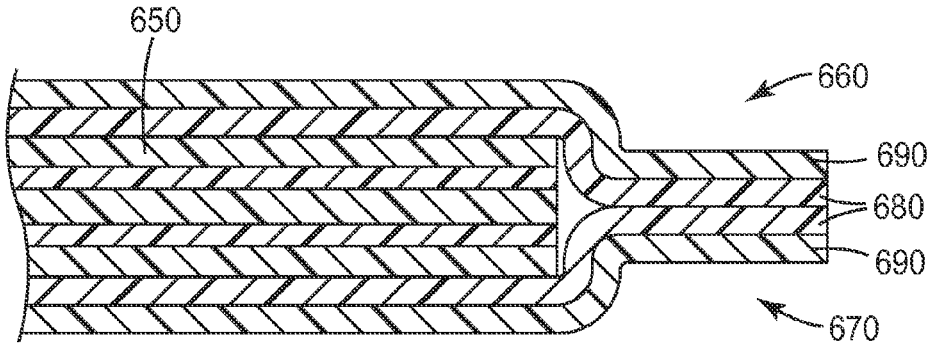

FIG. 6E illustrates another exemplary embodiment of edge insulated cable 650 with edge films constructed similar to the embodiment illustrated in FIG. 6D. In an exemplary embodiment, at least one of the edge films 660 and 670 may cover the entire cable surface of the cable 650 and form insulation structures along the lengthwise at both side of the cable.

Figure 7A:
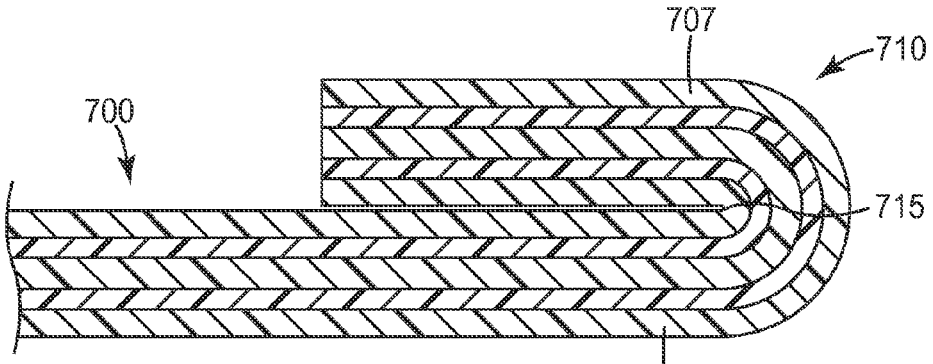
FIGS. 7A-7P illustrate a number of exemplary embodiments of edge insulation structures formed by folding.
Figure 7B:
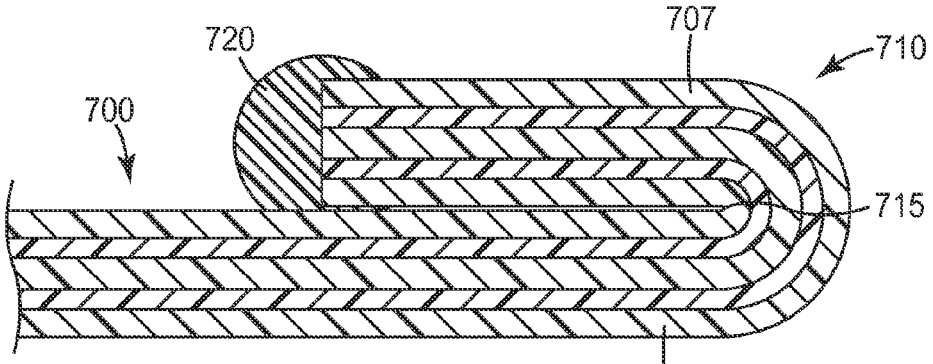
Figure 7C:
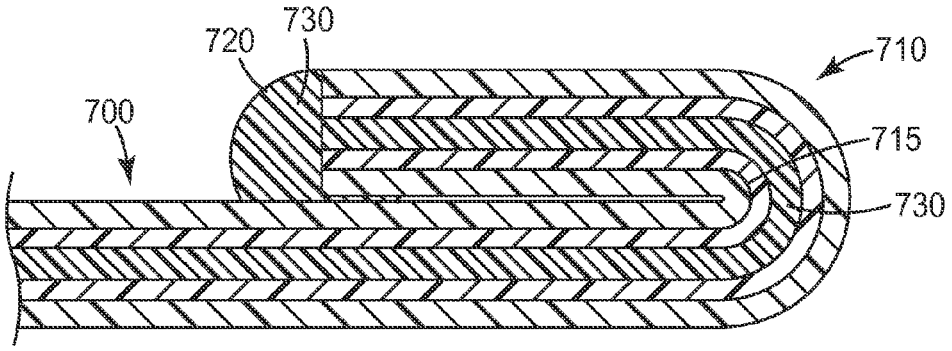
Figure 7D:
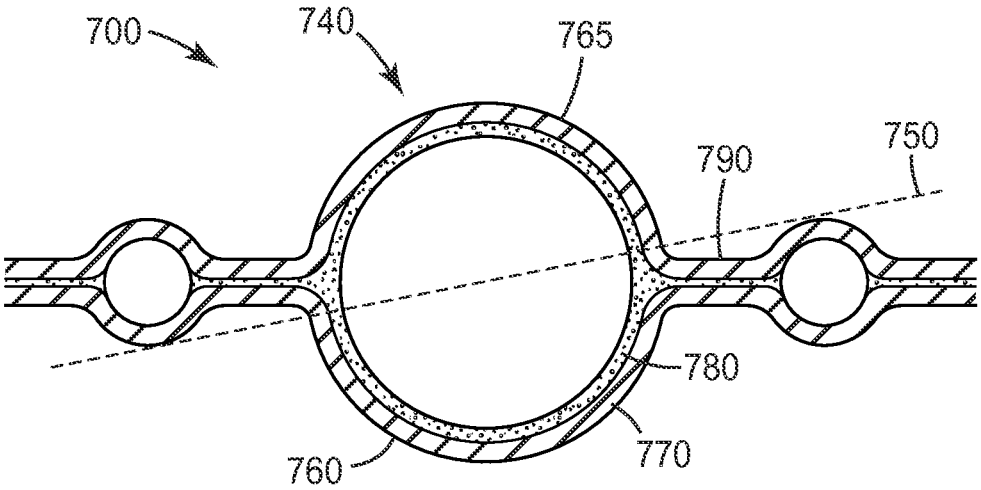
Figure 7E:
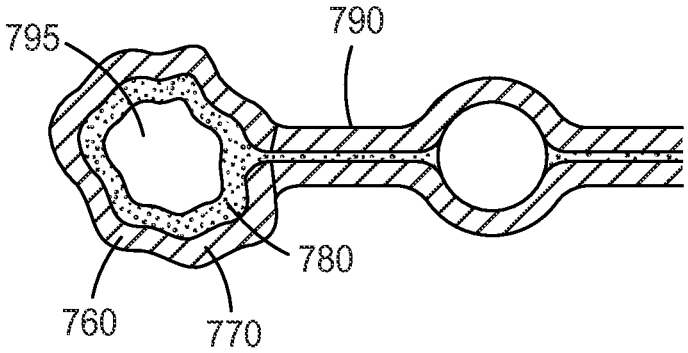
Figure 7F:
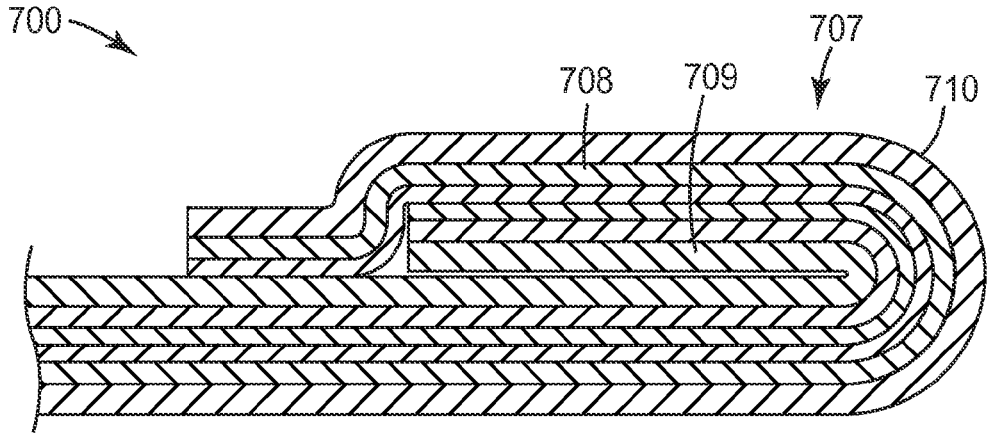
Figure 7G:
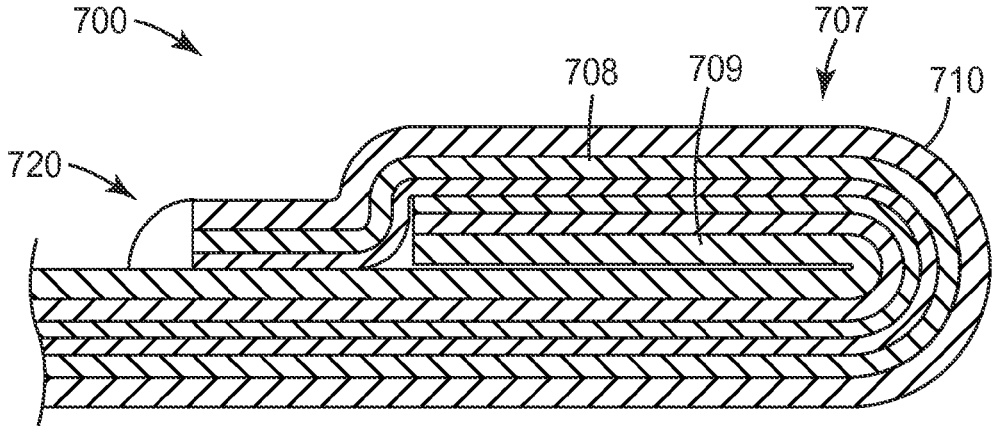
Figure 7H:
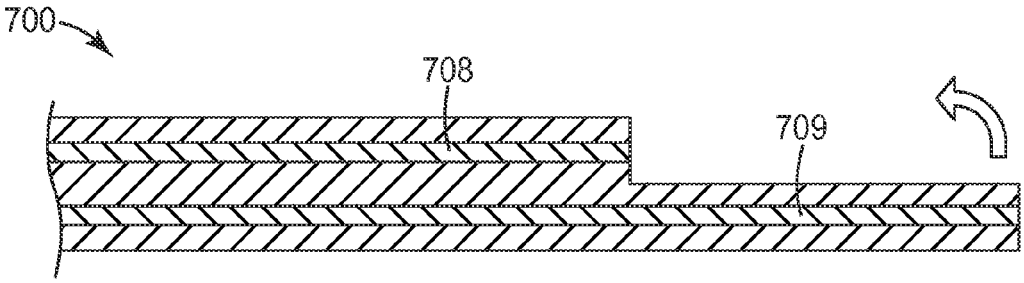
Figure 7I:
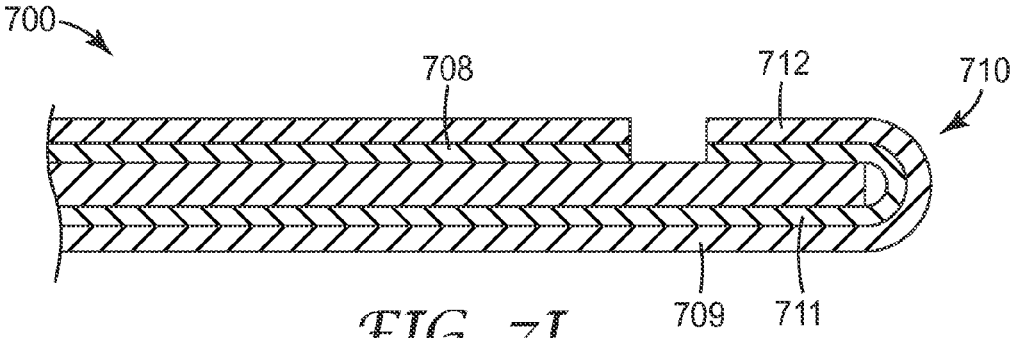
Figure 7J:
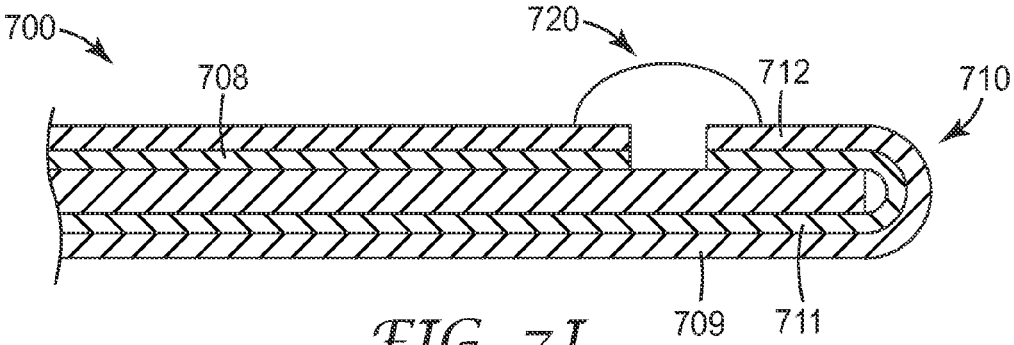
Figure 7K:
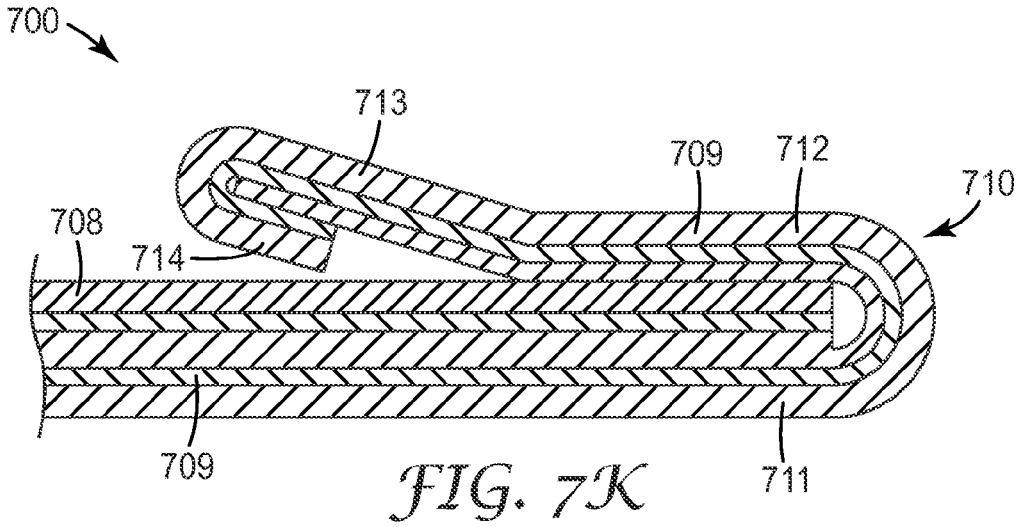
Figure 7L:
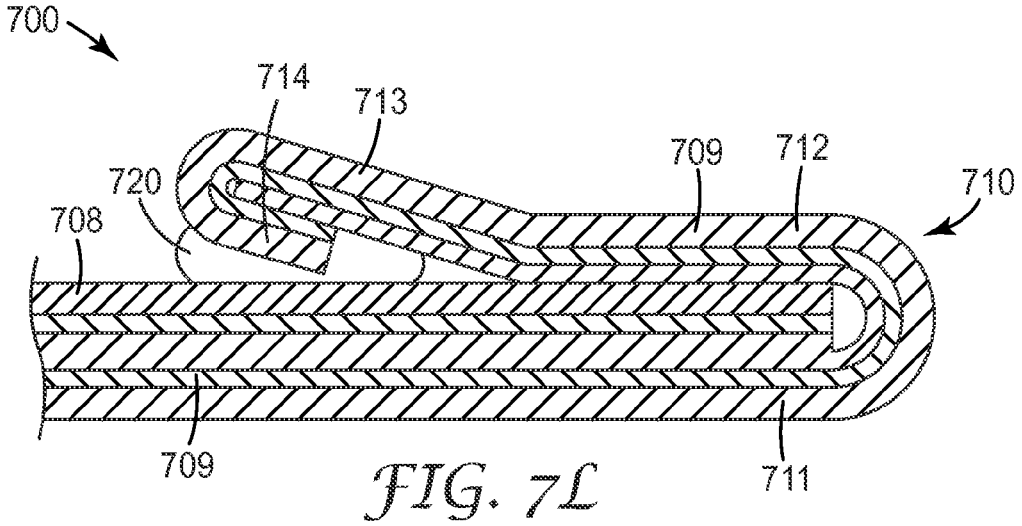
Figure 7M:
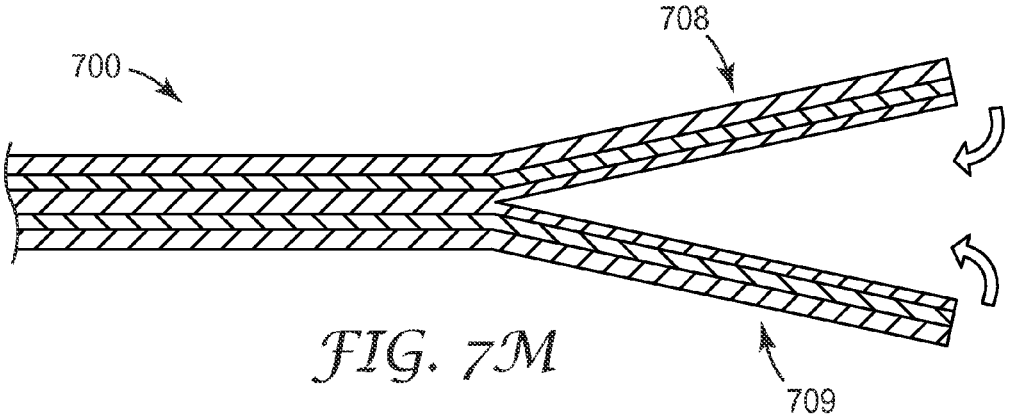
Figure 7N:
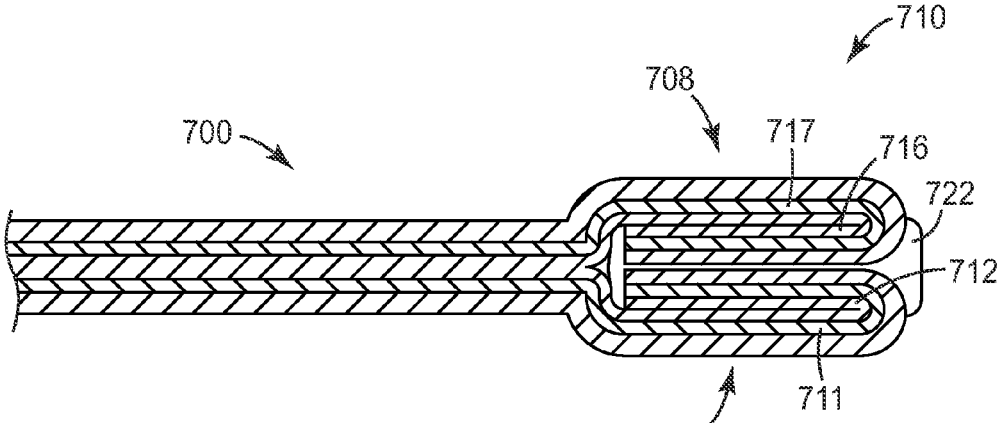
Figure 7O:
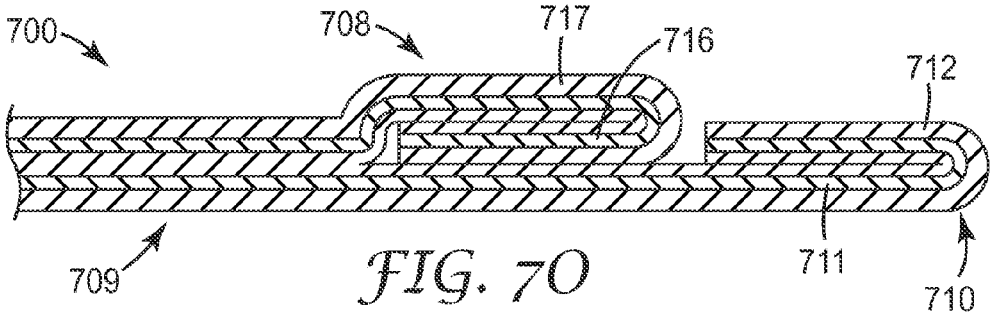
Figure 7P:
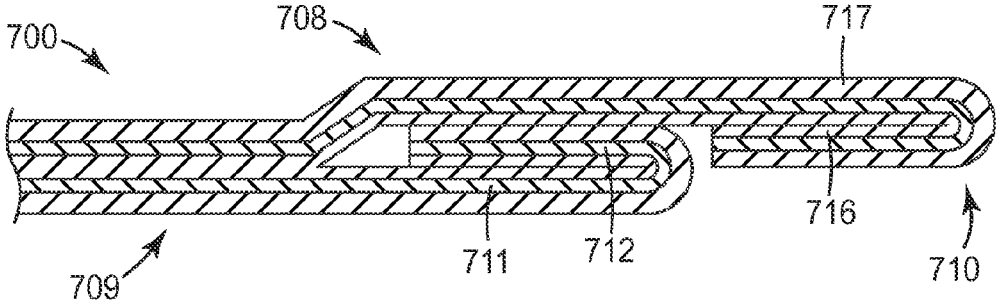

FIGS. 7A-7P illustrate a number of exemplary embodiment of edge insulation structure formed by folding. An electrical cable 700 has a conductive material disposed at a location near a longitudinal edge and is susceptible to making electrical contact at the edge. In some embodiments, the electrical cable 700 is folded along the length of the cable. The fold of the cable defines a first portion of the cable and a second portion of the cable, where the second portion of the cable includes the longitudinal edge of the cable. An edge insulation structure is formed by a bonding material bonding the second portion to the first portion along the length of the cable.

FIG. 7A illustrates an exemplary embodiment of an edge insulation structure 710 constructed by folding. In this embodiment, an electrical cable 700 is folded along the lengthwise line 715. The electrical cable 700 typically has a dielectric material layer as the outmost layers on both the top and bottom surfaces. The cable 700 has two portions separated by the line 715: a first portion 705 and a second portion 707. The second portion 707 includes the longitudinal edge of the cable 700. The second portion 707 can be folded over the first portion 705 and bonded to the first portion 705 by any bonding means, for example, by adhesive materials, hot melt materials, or the like. Thus, the edge insulation structure 710 is formed by a dielectric material layer covers the edge of the cable 700.

FIG. 7B illustrates another exemplary embodiment of an edge insulation structure 710 constructed by folding. In this embodiment, an electrical cable 700 is folded along the lengthwise line 715. The cable 700 has two portions separated by the line 715—a first portion 705 and a second portion 707. The second portion 707 includes the longitudinal edge of the cable 700. The second portion 707 can be folded on top of the first portion 705 and bonded to the first portion 705 by any bonding means, for example, by adhesive materials, hot melt materials, or the like. In an exemplary embodiment, the edge of the cable 700 can be further covered by an edge bead 720. The edge bead 720 can be constructed by one or more edge bead materials described above. Thus, the edge insulation structure 710 is formed.

FIG. 7C illustrates yet another exemplary embodiment of an edge insulation structure 710 constructed by folding. In this embodiment, an electrical cable 700 is folded along the lengthwise line 715. The fold defines a first portion 705 and a second portion 707. The second portion 707 includes the longitudinal edge of the cable 700. The second portion 707 can be folded on top of the first portion 705 and bonded to the first portion 705 by any bonding means, for example, by adhesive materials, hot melt materials, or the like. The edge of the cable 700 can be further covered by an edge bead 720. The edge bead 720 can include dielectric material 730. The dielectric material 730 may be used in the construction of the cable 700. The dielectric material 730 may be extruded from cable to cover the edge of the cable. Thus, the edge insulation structure 710 is formed.

In one embodiment, an electrical cable 700 is folded at a reservoir 740, as illustrated in FIGS. 7D and 7E. In this embodiment, the electrical cable 700 is separated (i.e., cut, etc.) at the reservoir 740. In an exemplary embodiment, the electrical cable 700 can be separated along a line 750 crossing the reservoir 740. The reservoir 740 includes two portions of films along the cutting line 750: a bottom film 760 and a top film 765. The bottom film 760 typically includes an insulating layer 770 as the outer layer. Next, the bottom film 760 of the reservoir 740 can wrap around the longitudinal edge of the cable 700. As illustrated in FIG. 7E, after the bottom film 760 wrap around the longitudinal edge of the cable 700, the insulating layer 770 becomes the outer layer covering the longitudinal edge of the cable 700 thus provides insulation to the edge. In some embodiments, the bottom film 760 comprises a conductive material layer 780 inside the insulating layer 770. In such implementations, the conductive material layer 780 can provide shielding and the insulating layer 770 remained as an outmost layer to provide insulation when the bottom film 760 is folded. The bottom film 760 may be bonded to the top surface 790 of the cable 700 by adhesive or other bonding materials to form an edge insulation structure 710. In some cases, the adhesive or bonding materials can be disposed inside the reservoir 740. In some implementations, a smaller cavity 795 containing residue material of the original reservoir 740 can be formed by the folding. In some other implementations, the folded structure can be flat with no cavity. In some implementations, the reservoir 740 can include an insulating layer 770. The cable 700 can be cut at the reservoir along the length of the cable, where the cut exposes a longitudinal edge of the cable. A portion of the insulation layer 770 of the reservoir remained with the cable can wrap around the longitudinal edge of the cable 700 to form an edge insulation structure.

FIGS. 7F and 7G illustrate some other embodiments of an edge insulation structure 710 formed by folding. Referring to FIG. 7F, an electrical cable 700 is folded and the fold defines a first portion 705 and a second portion 707. The second portion 707 includes the longitudinal edge of the cable 700. In some cases, the cable 700 can include conductive materials disposed at a location near the edge that is susceptible to make electrical contact at the location. The second portion 707 can be folded along the length of the cable toward the first portion 705 and bonded to the first portion 705 by any bonding means, for example, by adhesive materials, hot melt materials, or the like. The second portion 707 may have a first layer 708 and a second layer 709. In some implementations, the second layer 709 is cut or trimmed to be shorter than the first layer 708. The second layer 709 is covered by the first layer 708 to form the edge insulation structure 710.

FIG. 7G illustrates a similar implementation to the one illustrated in FIG. 7F, where an edge insulation structure 710 is formed by a second portion 707 folded over a first portion 705 then a first layer 708 covering a second layer 709 in the second portion 707. In some embodiments, an edge bead 720 can be applied to the edge of the first layer 708 to complete the edge insulation structure 710. The edge bead 720 can be constructed by one or more edge bead materials described above. In some implementations, the edge bead 720 can be constructed by materials that are used in the cable construction.

FIGS. 7H-7P illustrate a number of embodiments of edge insulation structure 710 formed by folding a certain layer of an electrical cable 700. In some embodiments, an electrical cable 700 has a first layer 708 and a second layer 709, where the second layer has a conductive material disposed near a longitudinal edge of the second layer and is susceptible to making electrical contact at the edge. The second layer 709 of the cable is folded along the length of the cable toward the first layer 708, and the fold defining a first portion 711 of the second layer and a second portion 712 of the second layer comprising the longitudinal edge of the second layer. An edge insulation structure is formed by a bonding material bonding the second portion 712 of the second layer to the second portion 712 of the second layer along the length of the cable.

FIGS. 7H and 7I illustrate an exemplary embodiment of edge insulation structure formed by folding Referring to FIG. 7H, an electrical cable 700 include a first layer 708 and a second layer 709. The second layer 709 may have a conductive material disposed near a longitudinal edge of the second layer and be susceptible to making electrical contact at the edge. Referring to FIG. 7I, the second layer 709 is folded along the length of the cable toward the first layer 708, and the fold defines a first portion 711 of the second layer 709 and a second portion 712 of the second layer 709. The second portion 712 may include the longitudinal edge of the second layer 709. An edge insulation structure 710 is formed by bonding the second portion 712 of the second layer to the first portion 711 of the second layer along the length of the cable by a bonding material.

FIG. 7J illustrates a similar embodiment to the one illustrated in FIG. 7I. In some embodiments, in addition to the folding illustrated in FIG. 7I, an edge bead 720 can be applied to the first layer 708 and the first portion 711 of the second layer 709 to complete the edge insulation structure 710. The edge bead 720 can be constructed by one or more edge bead materials described above. In some implementations, the edge bead 720 can be constructed by materials that are used in the cable construction.

FIG. 7K illustrates one embodiment of an edge insulation structure 710 formed by folding. An electrical cable 700 includes a first layer 708 and a second layer 709. The first layer 708 is trimmed to have a shorter length. The second layer 709 is folded along the length of the cable toward the first layer 708, and the fold defines a first portion 711 of the second layer 709 and a second portion 712 of the second layer 709. The second portion 712 of the second layer may include the longitudinal edge of the second layer 709. The second portion 712 of the second layer is further folded along the length of the cable toward the first layer 708, and the fold defines a third portion 713 and a fourth portion 714 of the second layer. An edge insulation structure 710 is formed by a bonding material bonding the fourth portion 714 of the second layer to the third portion 713 of the second layer along the length of the cable.

FIG. 7L illustrates a similar embodiment to the one illustrated in FIG. 7K. In some embodiments, in addition to the folding illustrated in FIG. 7K, an edge bead 720 can be applied to the first layer 708 and the fourth portion 714 of the second layer 709 to complete the edge insulation structure 710. The edge bead 720 can be constructed by one or more edge bead materials described above. In some implementations, the edge bead 720 can be formed by materials that are used in the cable construction.

FIGS. 7M and 7N illustrate an embodiment of constructing an edge insulation structure by folding. Referring to FIG. 7M, an electrical cable 700 can include a first layer 708 and a second layer 709. The electrical cable 700 typically has a dielectric outmost layer. Both the first layer 708 and the second layer 709 can be folded toward the other layer respectively. Referring to FIG. 7N, the second layer 709 can be folded along the length of the cable toward the first layer 708, and the fold defining a first portion 711 of the second layer 709 and a second portion 712 of the second layer 709. The second portion 712 of the second layer 709 may include the longitudinal edge of the second layer 709. The second portion 712 of the second layer can be bonded to the first portion 711 of the second layer along the length of the cable by a bonding material. The first layer 708 can be folded along the length of the cable toward the second layer 709, and the fold defining a first portion 717 of the first layer 708 and a second portion 716 of the first layer 708. The second portion 716 of the first layer 708 may include the longitudinal edge of the first layer 708. The second portion 716 of the first layer 708 can be bonded to the first portion 717 of the first layer 708 along the length of the cable by a bonding material. Thus, an edge insulation structure 710 is formed where the outmost layer, typically a dielectric material, of the cable 700 covers the edge. Optionally, in some implementations, the second portion 712 of the second layer 709 and the second portion 716 of the first layer 708 can be bonded by a bonding material 722. In some cases, the bonding material 722 can be used in the cable construction and the bonding material 722 is extruded from the cable.

FIGS. 7O and 7P illustrate two other embodiments of constructing an edge insulation structure by folding. Referring to FIGS. 7O and 7P, an electrical cable 700 can include a first layer 708 and a second layer 709. The electrical cable 700 typically has a dielectric outmost layer. Both the first layer 708 and the second layer 709 can be folded toward the other layer respectively. The second layer 709 can be folded along the length of the cable toward the first layer 708, and the fold defining a first portion 711 of the second layer 709 and a second portion 712 of the second layer 709. The second portion 712 of the second layer 709 may include the longitudinal edge of the second layer 709. The second portion 712 of the second layer can be bonded to the first portion 711 of the second layer along the length of the cable by a bonding material. Optionally, the first layer 708 can be folded along the length of the cable toward the second layer 709, and the fold defining a first portion 717 of the first layer 708 and a second portion 716 of the first layer 708. The second portion 716 of the first layer 708 may include the longitudinal edge of the first layer 708. The second portion 716 of the first layer 708 can be bonded to the first portion 717 of the first layer 708 along the length of the cable by a bonding material. Thus, an edge insulation structure 710 is formed where the outmost layer, typically a dielectric material, of the cable 700 covers the edge.

FIG. 7O illustrates an exemplary implementation where the first layer 708 is trimmed shorter than the second layer 709. In this embodiment, the second portion 716 of the first layer 708 can be bonded to the first portion 711 of the second layer 709 to form an edge insulation structure 710. FIG. 7P illustrates an exemplary implementation where the second layer 709 is trimmed shorter than the first layer 708 along the lengthwise of the cable 700. In this embodiment, the second portion 712 of the second layer 709 can be bonded to the first portion 717 of the first layer 708 to form an edge insulation structure 710.

Hot Melt Die Device

Figure 8:
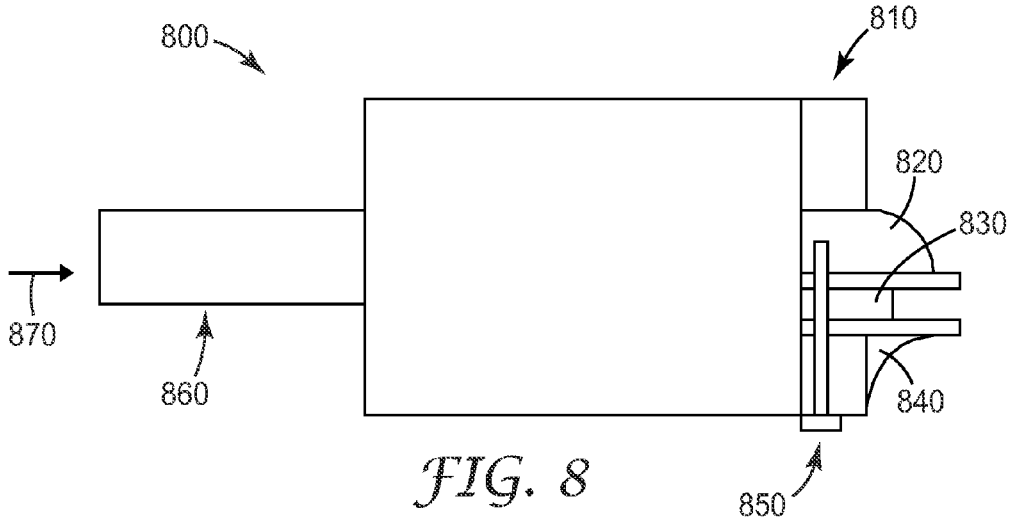
FIG. 8 illustrates an exemplary embodiment of a die assembly.

In some embodiments, edge beads may be constructed by a die assembly, as illustrated in FIG. 8. A die assembly may also be used to apply material to an edge of a film. In some embodiments, a die assembly can include a die that is configured to dispense a material through a die tip. In some implementations, an edge of a film is positioned proximate the die tip, where the die dispenses the material to at least one of a top and bottom surfaces of the film proximate and along the edge of the film. Thus, the dispensed material can form a coating region on the film, where the coating region is limited to near the edge of the film.

FIG. 8 illustrates an exemplary embodiment of a die assembly 800. In some embodiments, the die assembly 800 has a die tip 810 as a whole machine part. In some embodiment, the die tip 810 can include an upper die lip 820 and a lower die lip 840. Optionally, the die tip 810 can include a die insert 830 and a mechanical means 850 to assemble the die insert 830 with the die lips 820 and 840. In some implementations, optionally, a die feeding channel 860 can be inserted into the die tip 810 to allow materials to flow along a direction 870. A die assembly is configured to dispense material through the die tip 810. In some implementations, different die inserts 830 may be assembled into the die tip 810, which have different mechanical structures suitable to different film configurations and different edge configurations. In some implementations, an edge of a film can be disposed proximate, and the die assembly 800 dispenses a material to at least one of a top and bottom surfaces of the film proximate and along the edge of the film. The dispensed material forms a coated region on the film, where the coated region is limited to near the edge of the film. In some other implementations, a longitudinal edge of an electrical cable can be positioned proximate the die tip 810. The die assembly 800 can dispense an insulating material to at least one of a top and bottom surfaces of the film proximate and along the edge of the electrical cable. The insulating material is then allowed to flow over the longitudinal edge of the electrical cable. In some cases, the insulating material can be prevented a further flow by solidifying, curing, or other approaches.

Figure 9A:
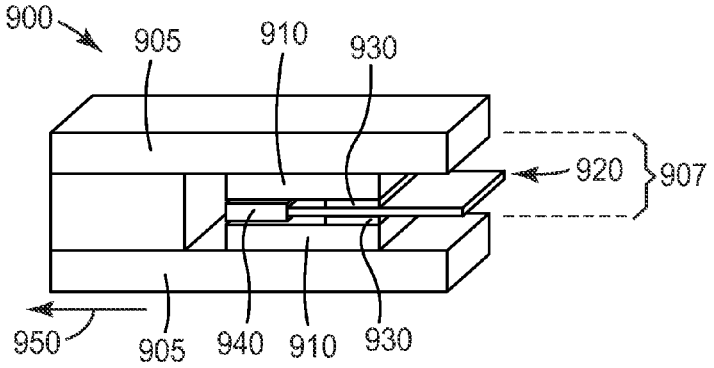
FIG. 9A illustrates a perspective view of an embodiment of a die tip.
Figure 9B:
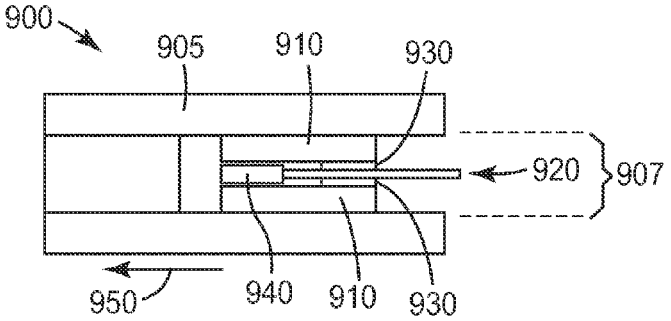
FIG. 9B illustrates a side view of the embodiment of the die assembly illustrated in FIG. 9A.
Figure 9C:
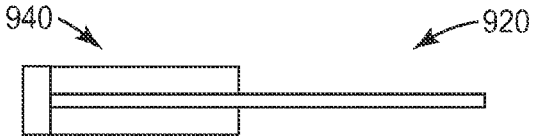
FIG. 9C illustrates a close-up view of an edge insulation structure covering an edge of a film.

FIG. 9A illustrates a perspective view of an embodiment of a die assembly 900 and a film 920. FIG. 9B illustrates a side view of the embodiment of the die assembly 900 illustrated in FIG. 9A. The die assembly 900 can include a die manifold 905 and a die tip 907. The die tip 907 can include two die lips 910: an upper die lip and a lower die lip. Optionally, the die assembly 900 may have a guiding insert 930 to keep the cable in the center position. In an exemplary embodiment, the die lips 910 can have a groove in the surface to guide the flow of edge insulating material 940. The edge insulating material 940 is flowing in the direction 950. In a particular embodiment, at least one of the two die lips 910 having a groove allows the edge insulating material 940 to flow through the groove onto at least one of the top and bottom surfaces of the film. In some implementations, the edge insulating material 940 can flow from at least one of the top and bottom surfaces of the film to cover the edge of the film 920, also illustrated in FIG. 9C.

Figure 10A:
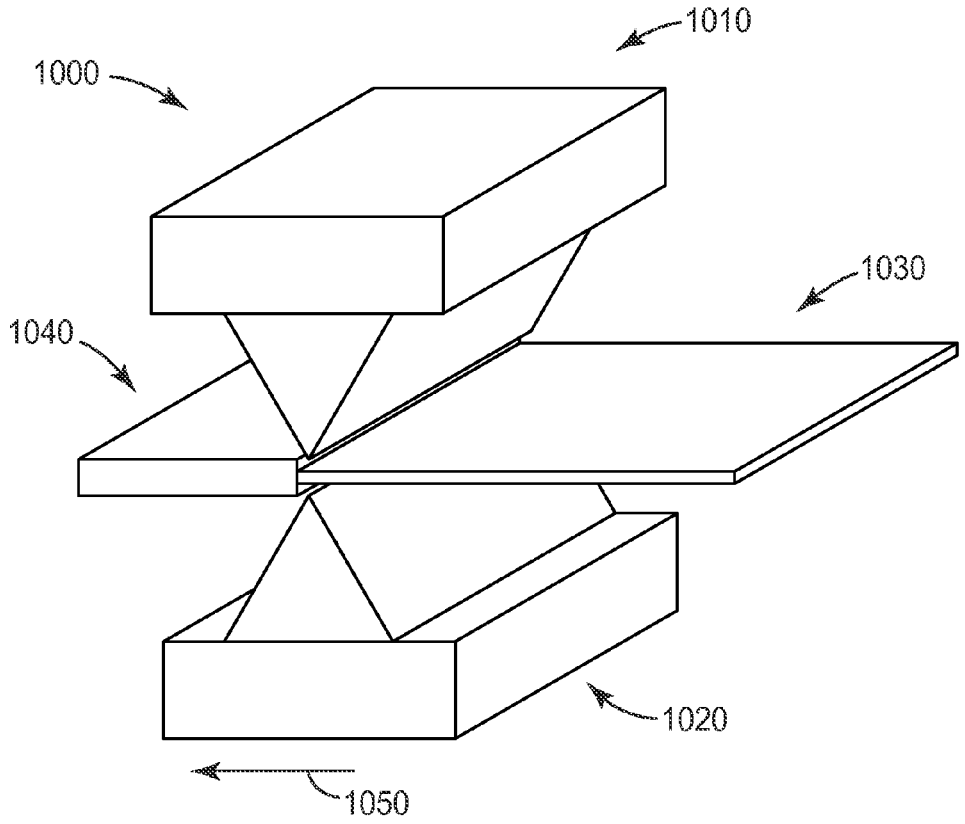
FIG. 10A illustrates a perspective view of another embodiment of a die tip.
Figure 10B:
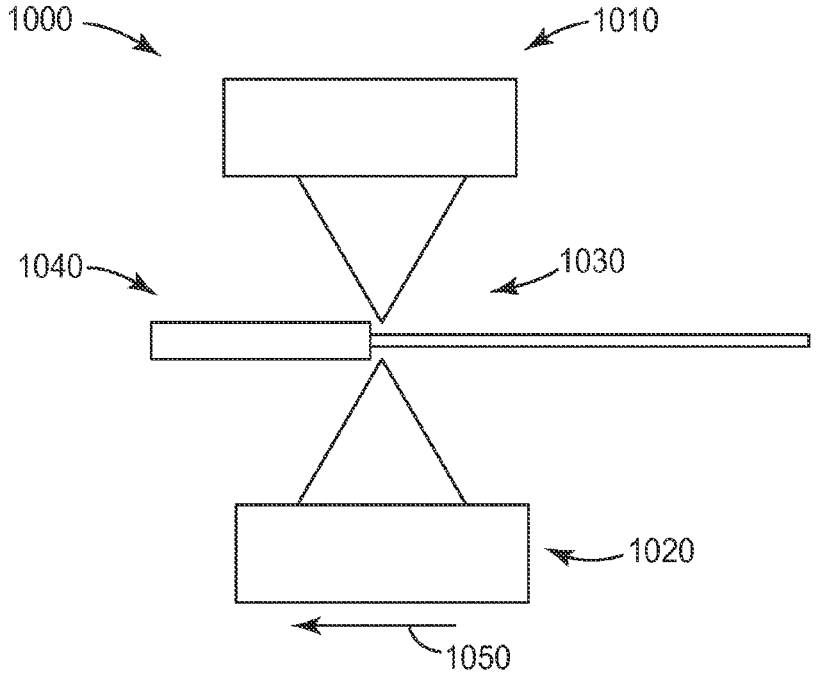
FIG. 10B illustrates a side view of the embodiment of the die tip illustrated in FIG. 10A.

FIG. 10A illustrates a perspective view of another embodiment of a die tip 1000 and FIG. 10B illustrates a side view of the embodiment of the die tip 1000 illustrated in FIG. 10A. The die tip 1000 can include a first die lip 1010 and a second die lip 1020 facing the first die lip 1010. In some embodiments, the first die lip 1010 and the second die lip 1020 can have a triangle cross-section at the dispensing portion. In some embodiments, a film 1030 can be disposed between the first die lip 1010 and the second die lip 1020. Edge insulating material 1040 can be dispensed from at least one of the first die lip 1010 and the second die lip 1020. In a particular embodiment that is important to provide sufficiently strong bonding of the edge insulating material 1040, the edge insulating material 1040 can be dispensed to the upper surface and/or the lower surface of the film 1030 and flow in the direction of 1050 to seal the edge of the film 1030.

In some embodiments, a die tip can include a dispensing portion allowing material to exit from the die tip. The dispensing portion may be in different shapes in cross section, for example, triangle, round, or the like. In some implementations, the dispensing portion can include a dispensing opening where material can exit from the die tip. The dispensing opening can be machined to a specific dimension. Alternatively, the dispensing opening can use shims to be able to vary the gap opening and change the material flow rate such that the thickness of the edge insulation structure can be adjusted to a desired thickness.

Figure 11A:
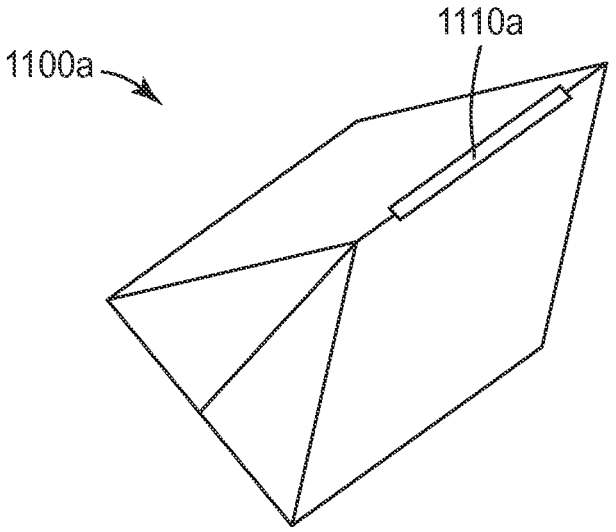
FIGS. 11A and 11B illustrates a close-up perspective view of two embodiments of a die tip.
Figure 11B:
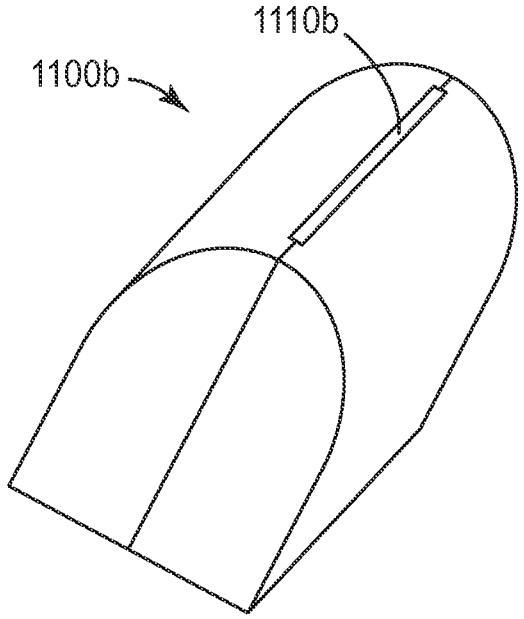

FIG. 11A illustrates a close-up perspective view of an embodiment of a die tip dispensing portion 1100*a*. The die tip dispensing portion 1100*a* has a dispensing portion with a triangle shaped cross section. The die tip dispensing portion 1100*a* has a dispensing opening 1110*a*. FIG. 11B illustrates a close-up perspective view of another embodiment of a die tip dispensing portion 1100*b*. The die tip dispensing portion 1100*b* has a dispensing portion with a round shaped cross section. The die tip dispensing portion 1100*b* has a dispensing opening 1110*b*.

Figure 12A:
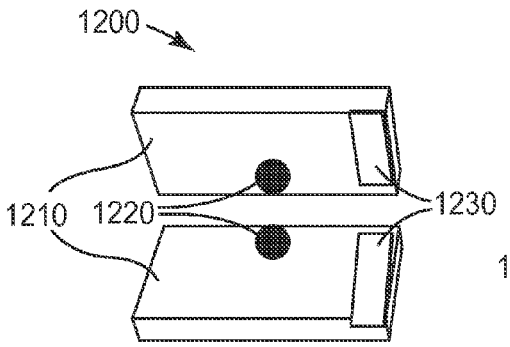
FIG. 12A illustrates a die lip open view of an embodiment of a die tip.
Figure 12B:
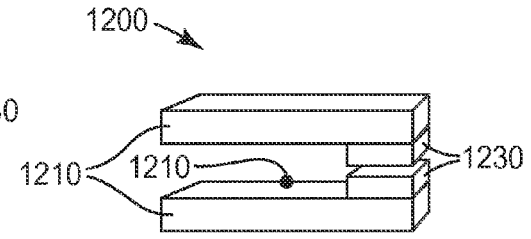
FIG. 12B illustrates a side view of the embodiment of the die tip illustrated in FIG. 12A.

A dispensing opening may have various shapes and positions at the die tip. For example, a dispensing opening can be a round opening, a slotted opening, or the like. FIG. 12A illustrates a die lip open view of an embodiment of a die tip 1200. FIG. 12B illustrates a side view of the embodiment of the die tip 1200 illustrated in FIG. 12A. The die tip 1200 has two die lips 1210 facing each other, two die inserts 1230, and two dispensing openings 1220. In some configurations, one die lip may have a dispensing opening 1220 and the other die lip may not have a dispensing opening. The dispensing opening 1220 can be generally round and positioned toward the back edge of the die lip 1210.

Figure 13A:
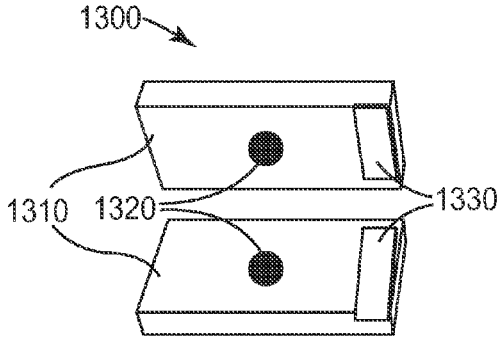
FIG. 13A illustrates a die lip open view of another embodiment of a die tip.
Figure 13B:
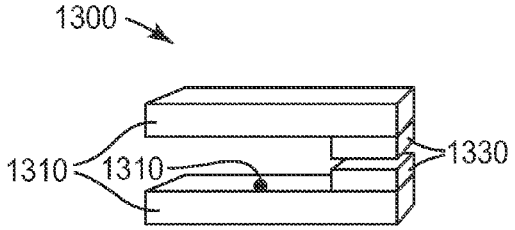
FIG. 13B illustrates a side view of the embodiment of the die tip illustrated in FIG. 13A.

FIG. 13A illustrates a die lip open view of another embodiment of a die tip 1300. FIG. 13B illustrates a side view of the embodiment of the die tip 1300 illustrated in FIG. 13A. The die tip 1300 has two die lips 1310 facing each other, two die inserts 1330, and two dispensing openings 1320. In some configurations, one die lip may have a dispensing opening 1320 and the other die lip may not have a dispensing opening. The dispensing opening 1320 can be generally round and positioned at the center of the die lip 1310.

Figure 14A:
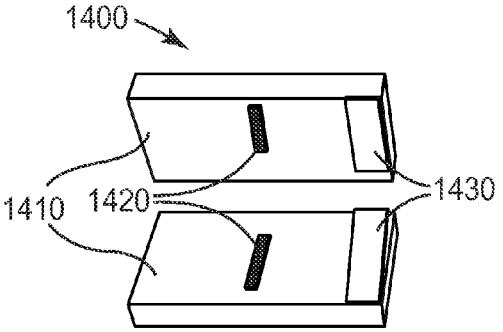
FIG. 14A illustrates a die lip open view of yet another embodiment of a die tip.
Figure 14B:
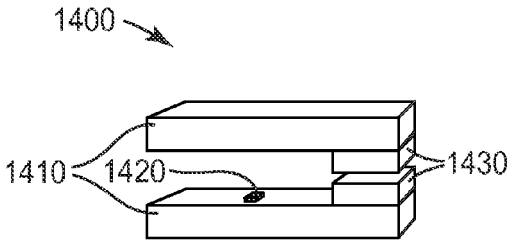
FIG. 14B illustrates a side view of the embodiment of the die tip illustrated in FIG. 14A.

FIG. 14A illustrates a die lip open view of yet another embodiment of a die tip 1400. FIG. 14B illustrates a side view of the embodiment of the die tip 1400 illustrated in FIG. 14A. The die tip 1400 has two die lips 1410 facing each other, two die inserts 1430, and two dispensing ports 1420. In some configurations, one die lip may have a dispensing port 1420 and the other die lip may not have a dispensing opening. The dispensing port 1420 can be a slotted opening. In a particular embodiment, the dispensing opening can be generally perpendicular to the flowing direction of dispensed materials.

Referring generally to FIGS. 15A-24B, edge insulation structures for electrical cables, such as, e.g., electrical cables similar to edge insulated cable 100 described herein and illustrated in FIG. 1, may include one or more unitary dielectric blocks. In at least one aspect, the presence of a unitary block can create a robust edge insulation structure that can protect the edge of the cable and make it electrically insulative. In at least one aspect, the unitary block is retained in the cable construction and extends outward from the edge of the cable to provide a robust solution.

Figure 15A:
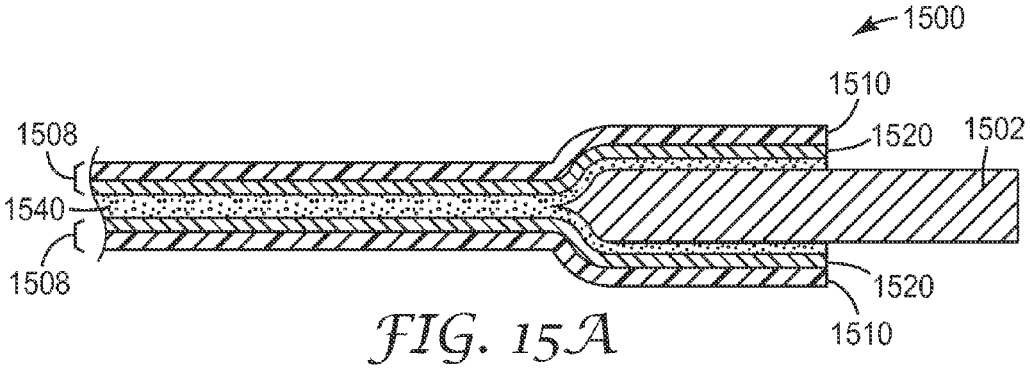
FIGS. 15A-15C illustrate three exemplary embodiments of edge insulation structures including a unitary block having a generally rectangular cross-section.
Figure 15B:
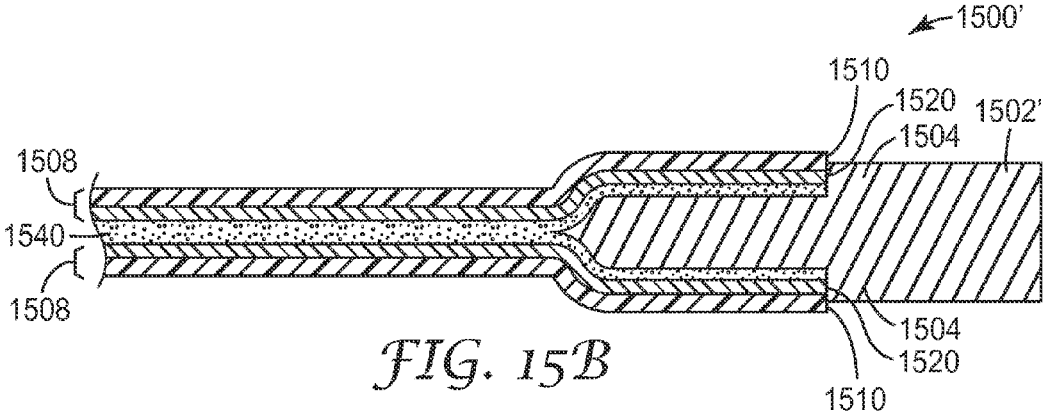
Figure 15C:
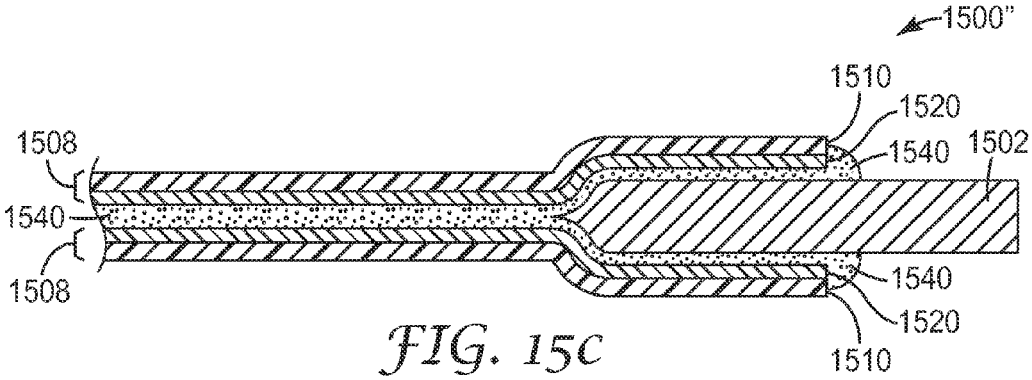

FIGS. 15A-15C illustrate three exemplary embodiments of edge insulation structures according to aspects of the present invention including a unitary block having a generally rectangular cross-section. Cable 1500, an edge portion of which is illustrated in FIG. 15A, includes one or more conductor sets, such as, e.g., conductor sets 104 illustrated in FIG. 1. Each conductor set extends along a length of the cable and includes one or more insulated conductors, such as, e.g., insulated conductors 106 illustrated in FIG. 1, each insulated conductor including a central conductor surrounded by a dielectric material. Cable 1500 further includes one or more dielectric unitary blocks 1502. Each unitary block 1502 extends along the length of the cable. Cable 1500 further includes first and second conductive shielding films 1508 disposed on opposite first and second sides of the conductor sets, e.g., similar to shielding films 108 as illustrated in FIG. 1, and unitary blocks 1502, e.g., as illustrated in FIG. 15A. First and second shielding films 1508 include cover portions and pinched portions arranged such that, in cross-section, the cover portions of the first and second shielding films in combination substantially surround each conductor set, e.g., similar to shielding films 108 as illustrated in FIG. 1, and each unitary block 1502, e.g., as illustrated in FIG. 15A, and the pinched portions of the first and second shielding films in combination form pinched portions of the cable on each side of the conductor set, e.g., similar to shielding films 108 as illustrated in FIG. 1, and on at least one side of unitary block 1502, e.g., as illustrated in FIG. 15A. Cable 1500 further includes an adhesive layer 1540 bonding the first shielding film to the second shielding film in the pinched portions of the cable, e.g., similar to shielding films 108 as illustrated in FIG. 1. As discussed elsewhere herein, the shielding films can have a variety of configurations. In the exemplary embodiment illustrated in FIG. 15A, shielding films 1508 include a non-conductive polymeric layer 1510 and a conductive layer 1520, examples of which are discussed elsewhere herein.

Cable 1500', an edge portion of which is illustrated in FIG. 15B, is similar to cable 1500. Whereas in cable 1500 unitary block 1502 does not cover a portion of a longitudinal edge of a shielding film 1508, in cable 1500' unitary block 1502' covers a portion of a longitudinal edge of both shielding films 1508. In alternative embodiments, unitary block 1502' may be configured such that it covers at least a portion of a longitudinal edge of at least one of the first and second conductive shielding films 1508. In at least one aspect, this may be achieved by unitary block 1502' having a stepped portion 1504. Stepped portion 1504 may be on only one side of cable 1500' (not shown) to cover at least a portion of a longitudinal edge of one conductive shielding film 1508, or it may be on both sides of cable 1500' (e.g., as illustrated in FIG. 15B) to cover at least a portion of a longitudinal edge of both conductive shielding films 1508. In at least one aspect, stepped portion 1504 may fully cover a longitudinal edge of conductive layer 1520 and either not cover (not shown), only partially cover (e.g., as illustrated in FIG. 15B), or fully cover (not shown) a longitudinal edge of non-conductive polymeric layer 1510. In at least one aspect, stepped portion 1504 may cover the longitudinal edges of any conductive layers of a conductive shielding film.

Cable 1500", an edge portion of which is illustrated in FIG. 15C, is similar to cable 1500'. Whereas in cable 1500' unitary block 1502' covers a portion of a longitudinal edge of both shielding films 1508, in cable 1500" unitary block 1502 does not cover a portion of a longitudinal edge of a shielding film 1508, but instead adhesive layer 1540 covers a portion of a longitudinal edge of both shielding films 1508. In alternative embodiments, adhesive layer 1540 may cover at least a portion of a longitudinal edge of at least one of the first and second conductive shielding films 1508.

In at least one aspect, the unitary block extends beyond the edges of the shielding films to provide the edge insulation for the cable. In at least one aspect, the edge insulation is realized by the distance between the longitudinal edge of the cable, defined by the longitudinal edge of the unitary block, and the longitudinal edge of at least one of the first and second shielding films.

The unitary blocks can be of any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. Additionally, the unitary blocks can include one or more additives and/or fillers to provide properties suitable for the intended application. The unitary blocks may be homogeneous dielectrics or layered dielectrics, and may or may not include adhesive layers. They may include a conductive, e.g., metal, core or internal layer, e.g., similar to an insulated wire. They may have an adhesive on one or both sides. The adhesive may be an adhesive of any suitable type, including, e.g., a hot melt adhesive. The unitary blocks may be anchored well into the cable construction by being sandwiched between two shielding films of the construction.

In at least one embodiment, the unitary block has a thickness of less than 1 mm. In other embodiments, the unitary block has a thickness of less than 0.5 mm, or less than 0.25 mm, or less than 0.1 mm. In the exemplary embodiments illustrated in FIGS. 15A-15C, the unitary block has a generally rectangular cross-section. The unitary block may have any suitable cross-section, such as, e.g., a generally curvilinear cross-section (such as, e.g., a generally oval or circular cross-section) or a generally rectilinear cross-section (such as, e.g., a generally rectangular or polygonal cross-section).

Figure 16A:
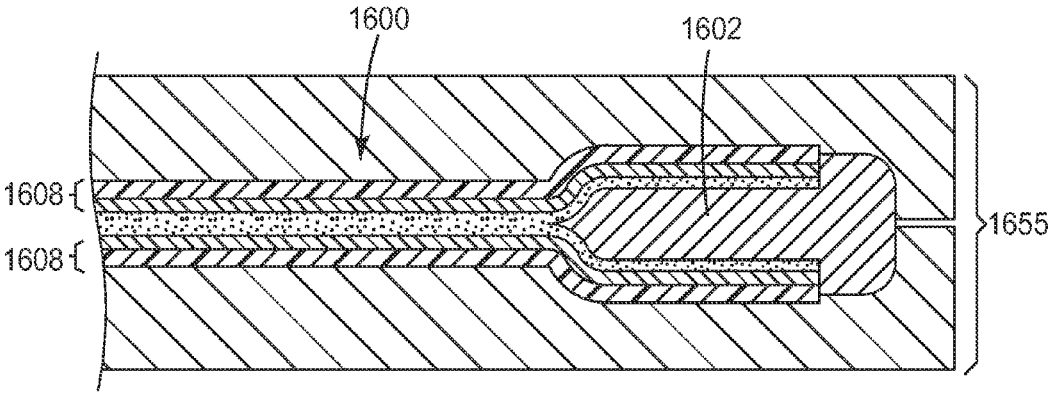
FIGS. 16A-16B illustrate an exemplary method of making edge insulation structures including a unitary block having a generally rectangular cross-section.
Figure 16B:
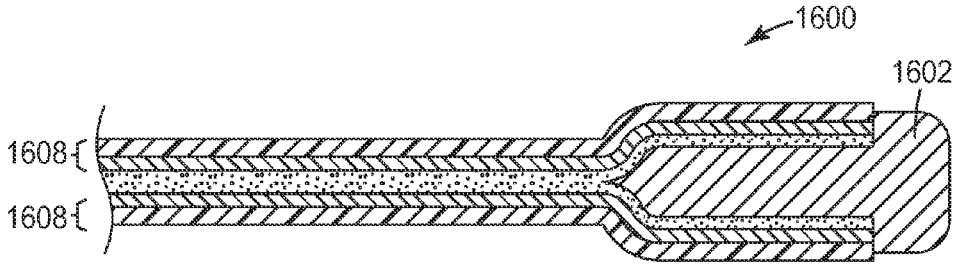

FIGS. 16A-16B illustrate an exemplary method of making edge insulation structures including a unitary block having a generally rectangular cross-section. In at least one aspect, shielding films 1608 of cable 1600 (similar to shielding films 1508 of cable 1500) are fed into formed rollers or platens 1655, and unitary block 1602 of cable 1600 is also fed between the shielding films into formed rollers 1655, as illustrated in FIG. 16A. In at least one aspect, shielding films 1608 bond to unitary block 1602 and enclose at least a portion of it. The resulting cable 1600 is illustrated in FIG. 16B. In at least one aspect, formed rollers 1655 form, in cross-section, an opening that generally corresponds to the cross-sectional shape of cable 1600.

Figure 17A:
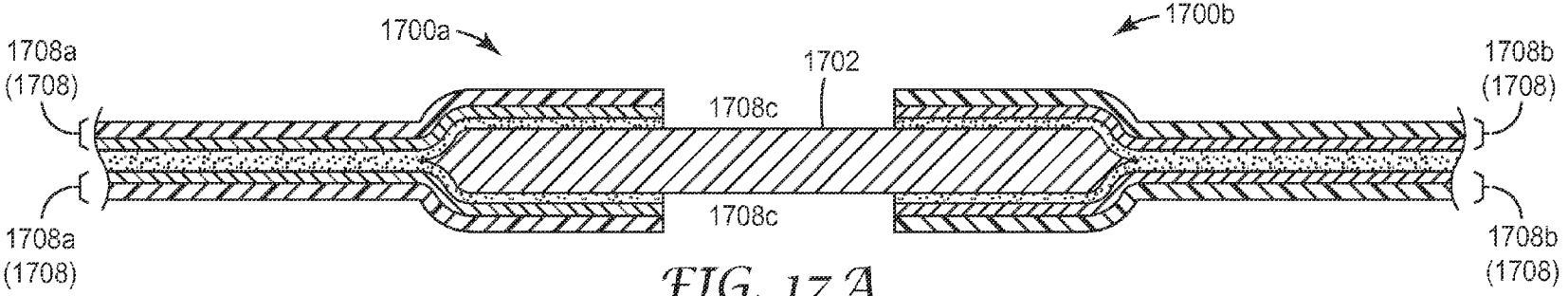
FIGS. 17A-17D illustrate another exemplary method of making edge insulation structures including a unitary block having a generally rectangular cross-section.
Figure 17B:
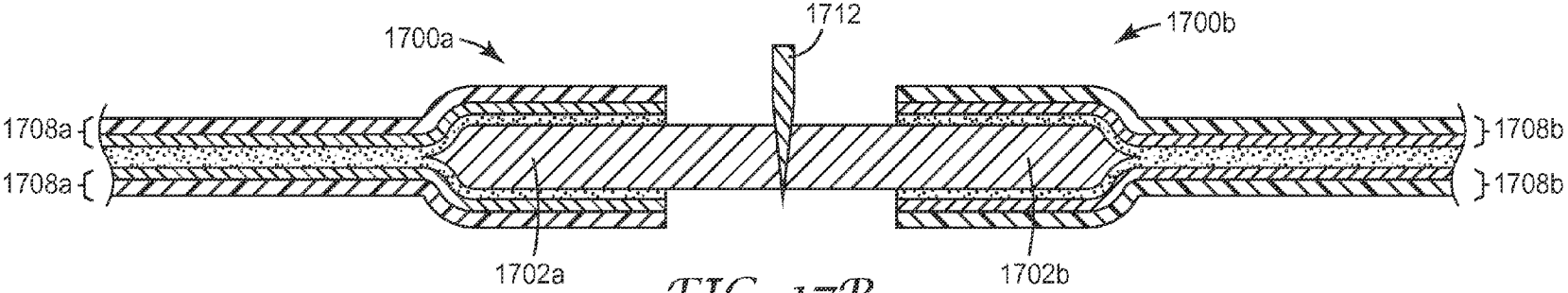
Figure 17C:
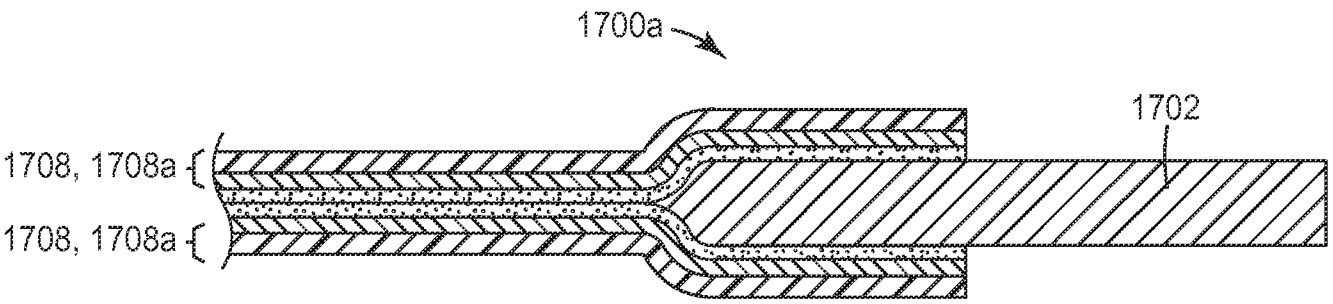
Figure 17D:
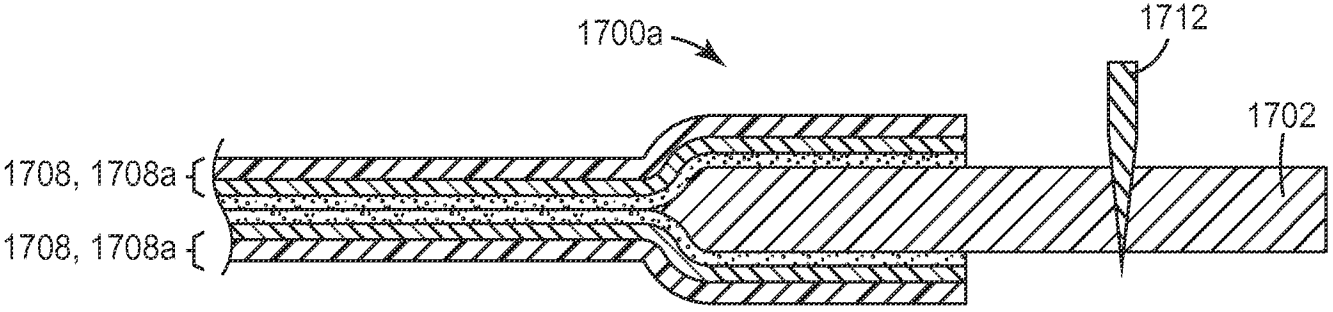

FIGS. 17A-17D illustrate another exemplary method of making edge insulation structures including a unitary block having a generally rectangular cross-section. This method enables making two edge insulation structures in a single operation. Referring to FIG. 17A, similar to the method described above with respect to FIGS. 16A-16B, a single unitary block 1702 is fed between shielding films 1708*a* of cable 1700*a* and shielding films 1708*b* of cable 1700*b*. In at least one aspect, single shielding films 1708 may be slit or otherwise separated to form an opening 1708*c* having a width selected to form shielding films 1708*a* and 1708*b* having a predetermined width. Alternatively, shielding films 1708*a* and 1708*b* may be trimmed to a predetermined width using any suitable known method. Then, as illustrated in FIG. 17B, single unitary block 1702 is slit, e.g., by using a slitting knife 1712, or otherwise separated into two unitary blocks, including one unitary block 1702*a* for cable 1700*a* and one unitary block 1702*b* for cable 1700*b*. The slitting or separating of unitary block 1702 may be done by any suitable known method, and may be done simultaneously with or subsequent to feeding the unitary block between the shielding films. Advantageously, as illustrated in FIGS. 17C-17D, the same method can be used to make a single edge insulation structure, whereby shielding films 1708*b* of cable 1700*b* are not present, and unitary block 1702 is fed between shielding films 1708*a* of cable 1700*a*, as illustrated in FIG. 17C, and simultaneously or subsequently slit, as illustrated in FIG. 17D.

Figure 18A:
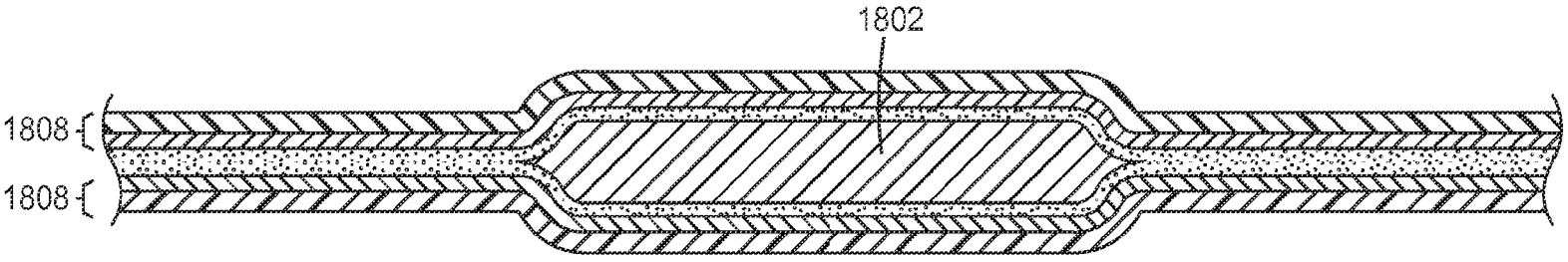
FIGS. 18A-18D illustrate another exemplary method of making edge insulation structures including a unitary block having a generally rectangular cross-section.
Figure 18B:
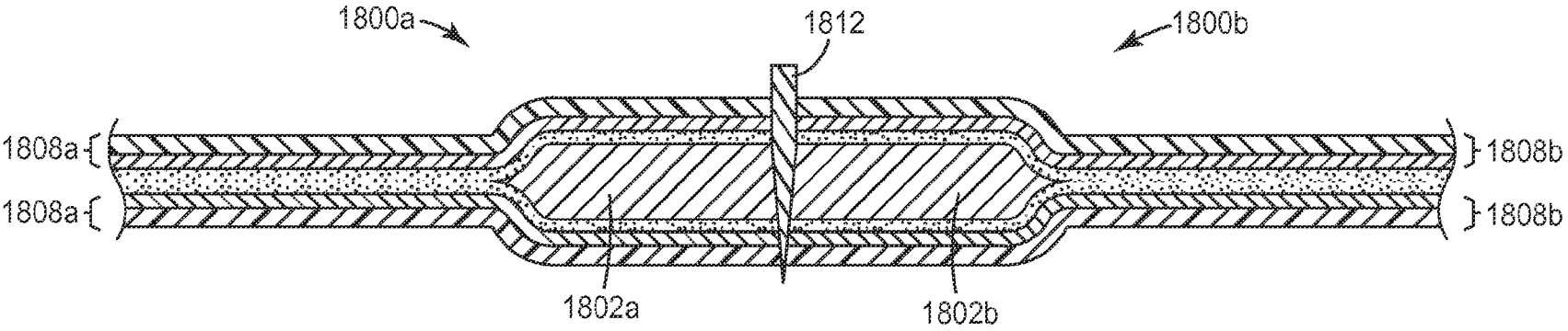
Figure 18C:
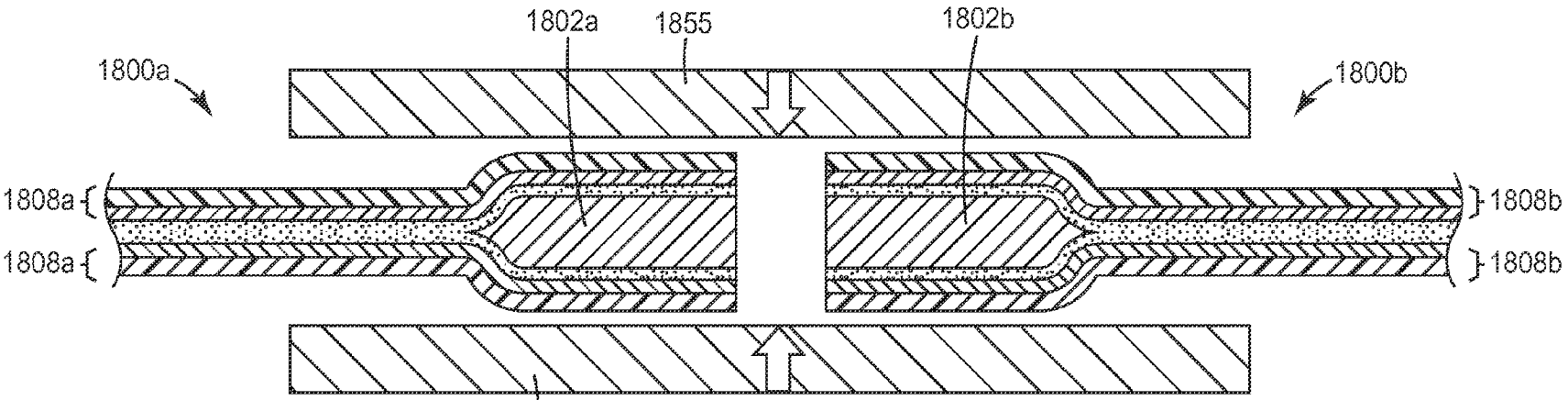
Figure 18D:
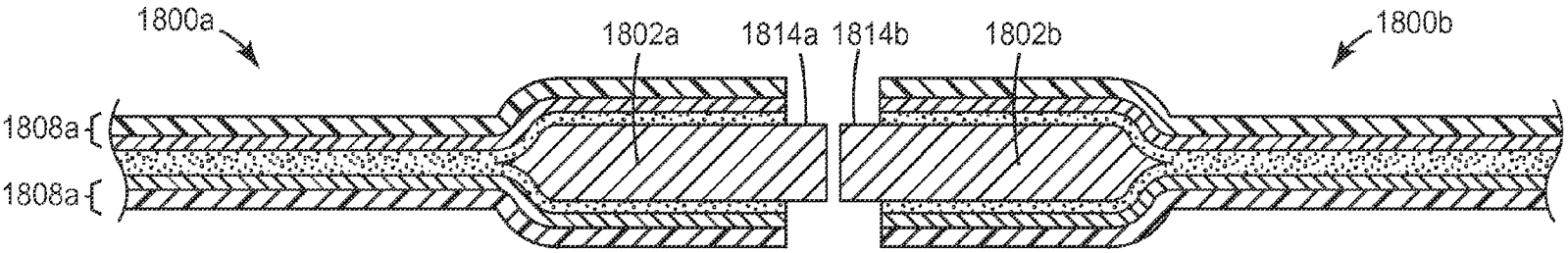

FIGS. 18A-18D illustrate another exemplary method of making edge insulation structures including a unitary block having a generally rectangular cross-section. This method enables making two edge insulation structures in a single operation whereby the shielding films do not need to be slit or otherwise separated or trimmed to width prior to the process of laminating the shielding films. In this method, as illustrated in FIG. 18A, shielding films 1808 substantially enclose unitary block 1802. Then, as illustrated in FIG. 18B, shielding films 1808 and unitary block 1802 are slit, e.g., by using a slitting knife 1812, or otherwise separated. As a result, cables 1800*a* and 1800*b* are formed, wherein cable 1800*a* includes the resulting shielding films 1808*a* and unitary block 1802*a*, and wherein cable 1800*b* includes the resulting shielding films 1808*b* and unitary block 1802*b*. As illustrated in FIG. 18C, pressure, and optionally heat, are applied to cables 1800*a* and 1800*b*, e.g., by using (heated) rollers or platens 1855 to form end portions 1814*a* and 1814*b* of unitary blocks 1802*a* and 1802*b*, respectively, that extend beyond the longitudinal edges of the respective shielding films to complete the edge insulation structures, as illustrated in FIG. 18D. Advantageously, the same method can be used to make a single edge insulation structure.

Figure 19A:
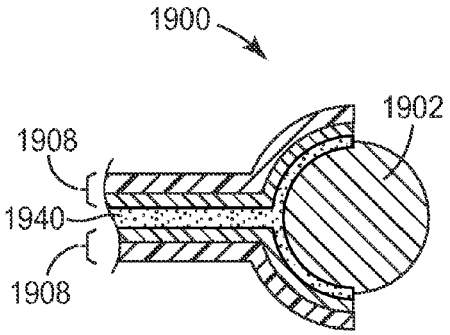
FIGS. 19A-19C illustrate three exemplary embodiments of edge insulation structures including a unitary block having a generally circular cross-section.
Figure 19B:
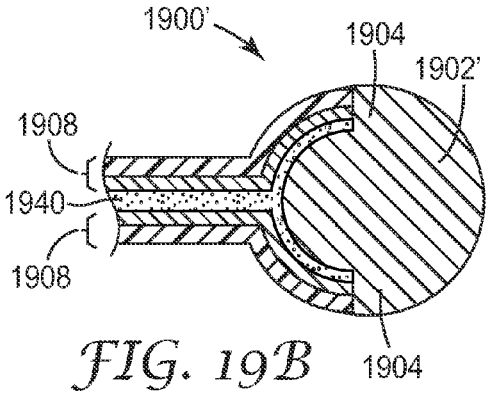
Figure 19C:
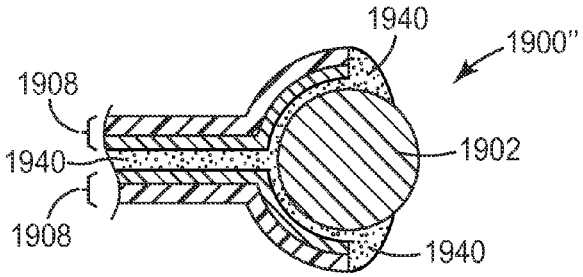

As mentioned earlier, the unitary block may have any suitable cross-section, such as, e.g., a generally curvilinear cross-section (such as, e.g., a generally oval or circular cross-section) or a generally rectilinear cross-section (such as, e.g., a generally rectangular or polygonal cross-section). FIGS. 19A-19C illustrate three exemplary embodiments of edge insulation structures including a unitary block having a generally circular cross-section.

Similar to cable 1500, cable 1900, an edge portion of which is illustrated in FIG. 19A, includes one or more conductor sets (not shown), one or more dielectric unitary blocks 1902, first and second conductive shielding films 1908, and an adhesive layer 1940. Unitary block 1902 has a generally circular cross-section.

Cable 1900', an edge portion of which is illustrated in FIG. 19B, is similar to cable 1900. Whereas in cable 1900 unitary block 1902 does not cover a portion of a longitudinal edge of a shielding film 1908, in cable 1900' unitary block 1902' covers a portion of a longitudinal edge of both shielding films 1908. In at least one aspect, this may be achieved by unitary block 1902' having a stepped portion 1904. In this respect, the edge insulation structure of cable 1900' is similar to that of cable 1500'.

Cable 1900", an edge portion of which is illustrated in FIG. 19C, is similar to cable 1900'. Whereas in cable 1900' unitary block 1902' covers a portion of a longitudinal edge of both shielding films 1908, in cable 1900" unitary block 1902 does not cover a portion of a longitudinal edge of a shielding film 1908, but instead adhesive layer 1940 covers a portion of a longitudinal edge of both shielding films 1908. In this respect, the edge insulation structure of cable 1900" is similar to that of cable 1500".

Figure 20A:
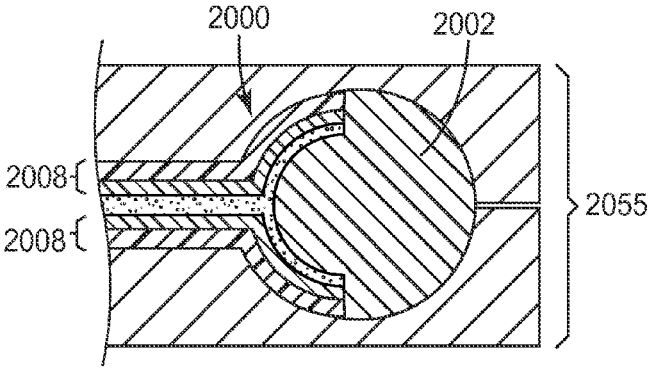
FIGS. 20A-20B illustrate an exemplary method of making edge insulation structures including a unitary block having a generally circular cross-section.
Figure 20B:
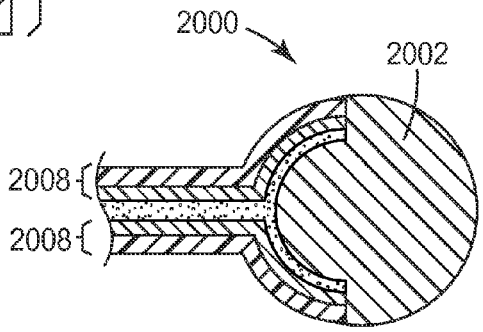

The methods of making edge insulation structures including a unitary block having a generally rectangular cross-section described herein may also be applied to making edge insulation structures including a unitary block having a different shape. For example, FIGS. 20A-20B illustrate an exemplary method of making edge insulation structures including a unitary block having a generally circular cross-section. Similar to the method illustrated in FIGS. 16A-16B, in at least one aspect, shielding films 2008 of cable 2000 (similar to shielding films 1908 of cable 1900') are fed into formed rollers or platens 2055, and unitary block 2002 of cable 2000 (similar to unitary block 1902' of cable 1900') is also fed between the shielding films into formed rollers 2055, as illustrated in FIG. 20A. In at least one aspect, shielding films 2008 bond to unitary block 2002 and enclose at least a portion of it. The resulting cable 2000 is illustrated in FIG. 20B. In at least one aspect, formed rollers 2055 form, in cross-section, an opening that generally corresponds to the cross-sectional shape of cable 2000.

Figure 21:
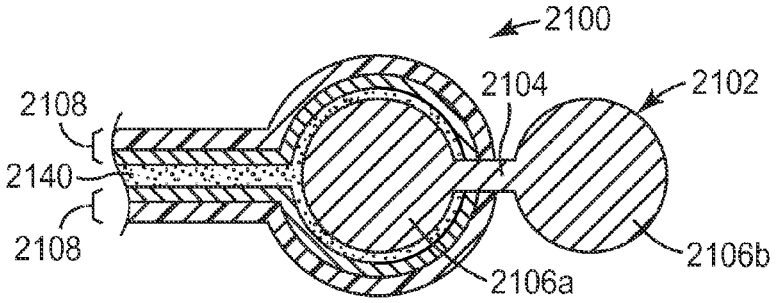
FIG. 21 illustrates an exemplary embodiment of an edge insulation structure including a unitary block having a bilobal cross-section.

FIG. 21 illustrates an exemplary embodiment of an edge insulation structure including a unitary block having a bilobal cross-section. Cable 2100, an edge portion of which is illustrated in FIG. 21, includes one or more conductor sets, such as, e.g., conductor sets 104 illustrated in FIG. 1. Each conductor set extends along a length of the cable and includes one or more insulated conductors, such as, e.g., insulated conductors 106 illustrated in FIG. 1, each insulated conductor including a central conductor surrounded by a dielectric material. Cable 2100 further includes a dielectric unitary block 2102. Unitary block 2102 is disposed along an edge of the cable and extends along the length of the cable. Unitary block 2102 has a bilobal cross-section having a thinner middle portion 2104 disposed between two thicker first and second lobes 2106*a* and 2106*b*, respectively. Cable 2100 further includes first and second conductive shielding films 2108 disposed on opposite first and second sides of the conductor sets, e.g., similar to shielding films 108 as illustrated in FIG. 1, and unitary block 2102, e.g., as illustrated in FIG. 21. First and second shielding films 2108 include cover portions and pinched portions arranged such that, in cross-section, the cover portions of the first and second shielding films in combination substantially surround each conductor set, e.g., similar to shielding films 108 as illustrated in FIG. 1, and first lobe 2106*a* of unitary block 2102, e.g., as illustrated in FIG. 21, and the pinched portions of the first and second shielding films in combination form pinched portions of the cable on each side of the conductor set, e.g., similar to shielding films 108 as illustrated in FIG. 1, and on a side of first lobe 2106*a* opposite second lobe 2106*b*, an edge of each of the first and second conductive shielding films being disposed in thinner middle portion 2104 of unitary block 2102, e.g., as illustrated in FIG. 21. Cable 2100 further includes an adhesive layer 2140 bonding the first shielding film to the second shielding film in the pinched portions of the cable, e.g., similar to shielding films 108 as illustrated in FIG. 1, and bonding first and second shielding films 2108 to first lobe 2106*a* of unitary block 2102, e.g., as illustrated in FIG. 21. In at least one aspect, first lobe 2106*a* of unitary block 2102 functions to anchor or retain unitary block 2102 between shielding films 2108, and second lobe 2106*b* functions to protect the longitudinal edge of cable 2100. In at least one aspect, an advantage of a bilobal cross-section is that it enables the longitudinal edges of the shielding films to be concealed in the intrusions between the lobes, e.g., as illustrated in FIG. 21. Although in the exemplary embodiment illustrated in FIG. 21 first lobe 2106*a* and second lobe 2106*b* have a generally circular cross-section, in other embodiments, at least to perform these functions, first lobe 2106*a* and second lobe 2106*b* may have any suitable cross-section. In at least one aspect, first and second shielding films 2108 may at least partially cover first lobe 2106*a* and may extend to also partially cover second lobe 2106*b*.

Figure 22A:
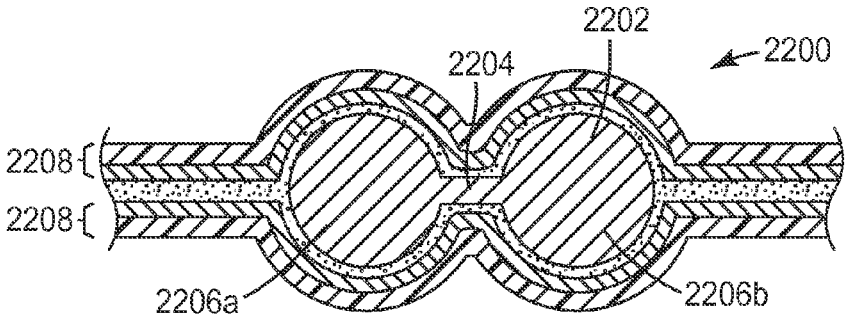
FIGS. 22A-22C illustrate an exemplary method of making edge insulation structures including a unitary block having a bilobal cross-section.
Figure 22B:
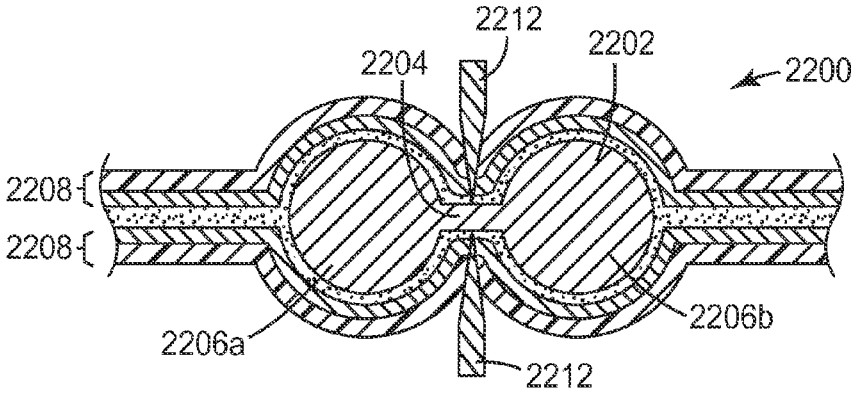
Figure 22C:
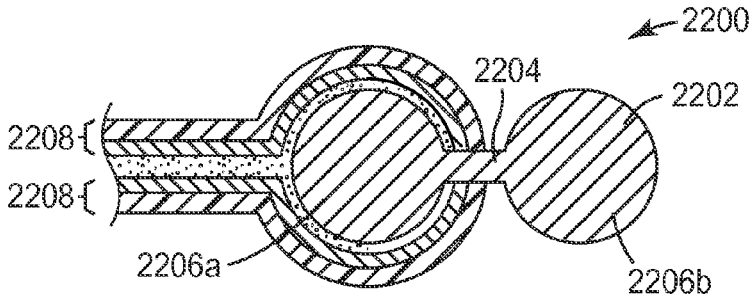

FIGS. 22A-22C illustrate an exemplary method of making edge insulation structures including a unitary block having a bilobal cross-section. In this method, as illustrated in FIG. 22A, shielding films 2208 substantially enclose unitary block 2202 having a bilobal cross-section having a thinner middle portion 2204 disposed between two thicker first and second lobes 2206*a* and 2206*b*, respectively. Then, as illustrated in FIG. 22B, shielding films 2208 are slit in the area of thinner middle portion 2204 of unitary block 2202, e.g., by using slitting knives 2212, and the portions of shielding films 2208 covering second lobe 2206*b* are removed from second lobe 2206*b*. As a result, cable 2200 is formed, wherein first and second shielding films 2208 in combination substantially surround first lobe 2206*a* of unitary block 2202, and wherein an edge of each of first and second shielding films 2208 is disposed in thinner middle portion 2204 of unitary block 2202, as illustrated in FIG. 22C.

Figure 23A:
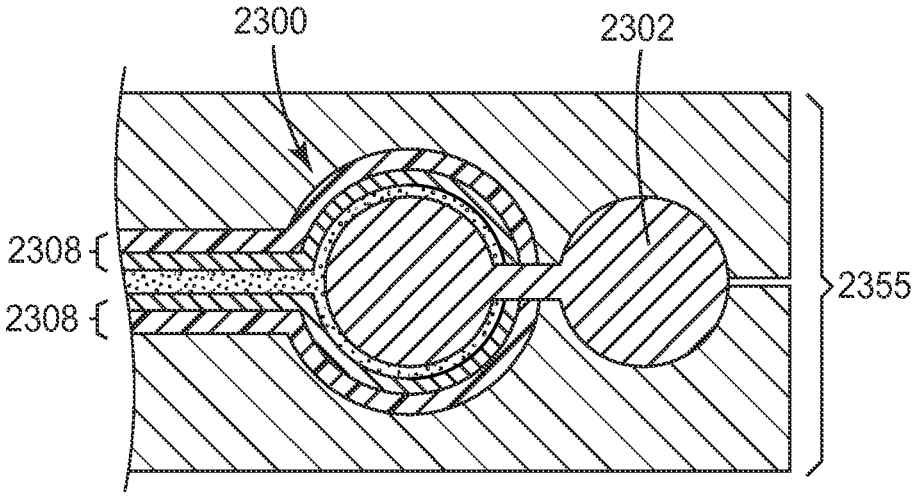
FIGS. 23A-23B illustrate another exemplary method of making edge insulation structures including a unitary block having a bilobal cross-section.
Figure 23B:
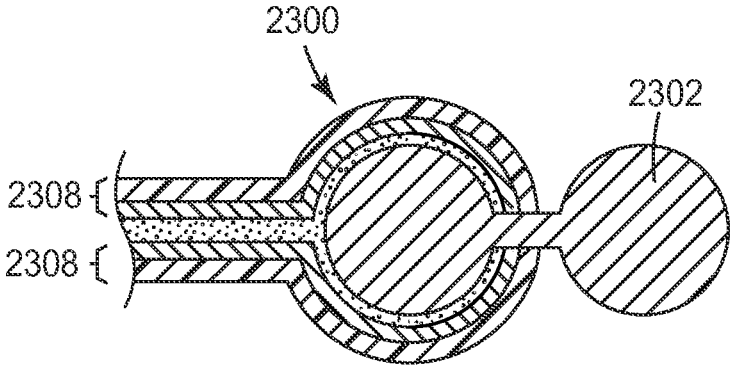

FIGS. 23A-23B illustrate another exemplary method of making edge insulation structures including a unitary block having a bilobal cross-section. Similar to the methods illustrated in FIGS. 16A-16B and FIGS. 20A-20B, in at least one aspect, shielding films 2308 of cable 2300 (similar to shielding films 2108 of cable 2100) are fed into formed rollers or platens 2355, and unitary block 2302 of cable 2300 (similar to unitary block 2102 of cable 2100) is also fed between the shielding films into formed rollers 2355, as illustrated in FIG. 23A. In at least one aspect, shielding films 2308 bond to unitary block 2302 and enclose at least a portion of it. The resulting cable 2300 is illustrated in FIG. 23B. In at least one aspect, formed rollers 2355 form, in cross-section, an opening that generally corresponds to the cross-sectional shape of cable 2300.

In at least one aspect, edge insulation structures for electrical cables may also be created by generating a break in the conductive layers of the conductive shielding films of the cable followed by sealing. This would create a region near the edge of the cable where the conductive layers are recessed from the edge of the cable. In at least one aspect, this may be accomplished by stretching or otherwise deforming, optionally with the application of heat, the conductive shielding films sufficiently laterally such as to form an opening in the conductive layers while stretching the substrates of the conductive shielding films on which the conductive layers are disposed (and the adhesive layer of the cable). In at least one aspect, this formation of a reservoir is possible if the conductive layers have a lower elongation to failure than the substrates on which they are disposed. The cable can then be slit in an area corresponding to the reservoir to create one or two edge insulation structures.

Figure 24A:
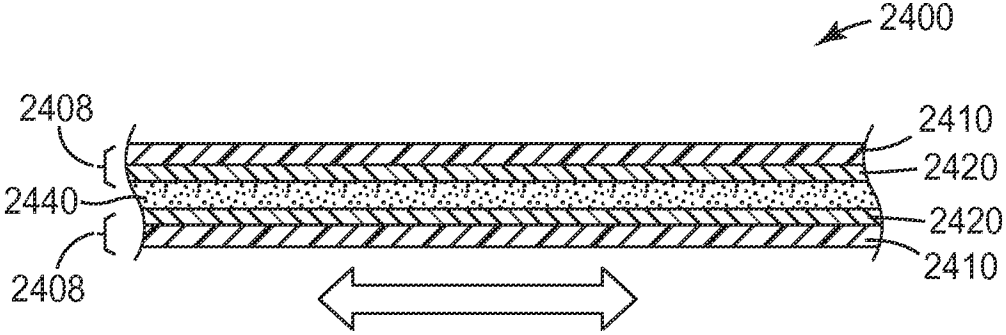
FIGS. 24A-24D illustrate an exemplary method of making and exemplary embodiments of edge insulation structures including one or more reservoirs.
Figure 24B:
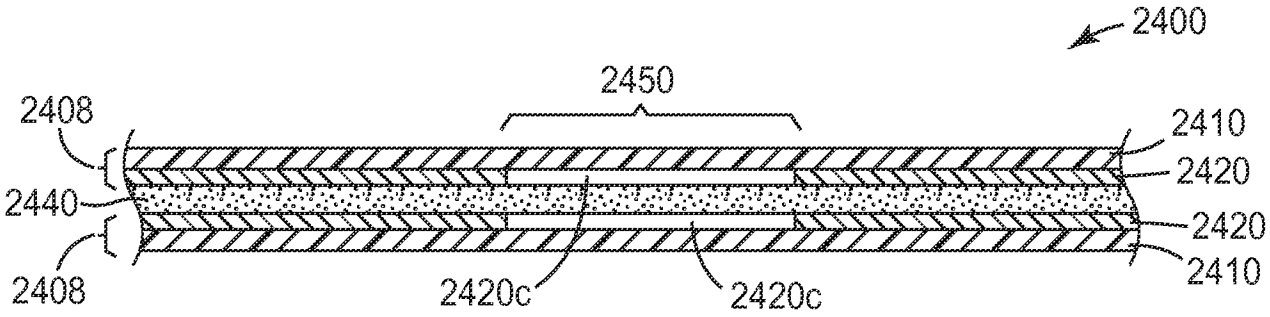

FIGS. 24A-24D illustrate an exemplary method of making and exemplary embodiments of edge insulation structures including one or more reservoirs. Cable 2400, a portion of which is illustrated in FIG. 24A, includes one or more conductor sets, such as, e.g., conductor sets 104 illustrated in FIG. 1. Each conductor set extends along a length of the cable and includes one or more insulated conductors, such as, e.g., insulated conductors 106 illustrated in FIG. 1, each insulated conductor including a central conductor surrounded by a dielectric material. As illustrated in FIG. 24B, cable 2400 further includes one or more reservoirs 2450. Each reservoir 2450 extends along the length of the cable and is filled with a first dielectric material. In the exemplary embodiment illustrated in FIG. 24B, the first dielectric material includes an adhesive. In at least one aspect, the adhesive is a portion of adhesive layer 2440 of cable 2400. Cable 2400 further includes first and second conductive shielding films 2408 disposed on opposite first and second sides of the conductor sets, e.g., similar to shielding films 108 as illustrated in FIG. 1, and reservoirs 2450, e.g., as illustrated in FIG. 24B. First and second shielding films 2408 include cover portions and pinched portions arranged such that, in cross-section, the cover portions of the first and second shielding films in combination substantially surround each conductor set, e.g., similar to shielding films 108 as illustrated in FIG. 1, and each reservoir 2450, e.g., as illustrated in FIG. 24B, and the pinched portions of the first and second shielding films in combination form pinched portions of the cable on each side of the conductor set, e.g., similar to shielding films 108 as illustrated in FIG. 1, and reservoir 2450, e.g., as illustrated in FIG. 24B. Cable 2400 further includes an adhesive layer 2440 bonding the first shielding film to the second shielding film in the pinched portions of the cable, e.g., similar to shielding films 108 as illustrated in FIG. 1. First and second shielding films 2408 include respective first and second conductive layers 2420 disposed on respective first and second substrates 2410 and facing each other. In at least one aspect, first and second substrates 2410 include a non-conductive polymeric layer, examples of which are discussed elsewhere herein. In a cover portion corresponding to a reservoir, first conductive layer 2420, but not first substrate 2410 includes an opening 2420*c*. Opening 2420*c* extends along at least a portion of the length of the cable. Reservoirs 2450 may be formed by stretching first and second shielding films 2408 (and adhesive layer 2440) laterally, as indicated by the arrow in FIG. 24A, such that conductive layers 2420 break and form opening 2420*c*, while substrates 2410 (and adhesive layer 2440) laterally elongate without breaking and forming an opening. The resulting cable construction is illustrated in FIG. 24B. In at least one aspect, the stretching may be done locally and optionally with the application of heat. In at least one aspect, localized stretching may be achieved by including longitudinal notches (not shown) in one or more layers of the shielding films. Longitudinal notches may be added before or after building the layer structure of the shielding films. In at least one aspect, the stretching of the shielding films may be done before or after lamination of the shielding films into a cable construction. If the stretching is done before lamination, the openings in the conductive layers can be aligned during lamination.

Figure 24C:
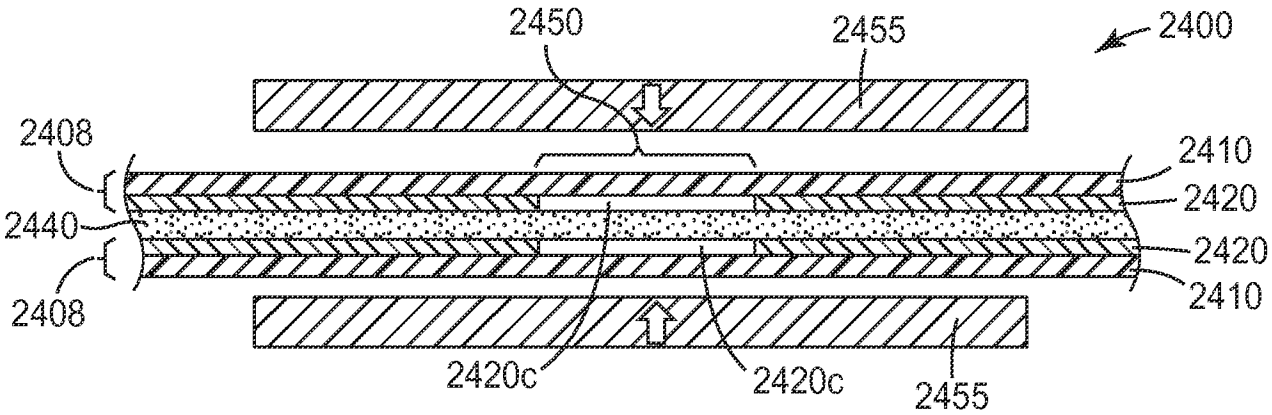
Figure 24D:
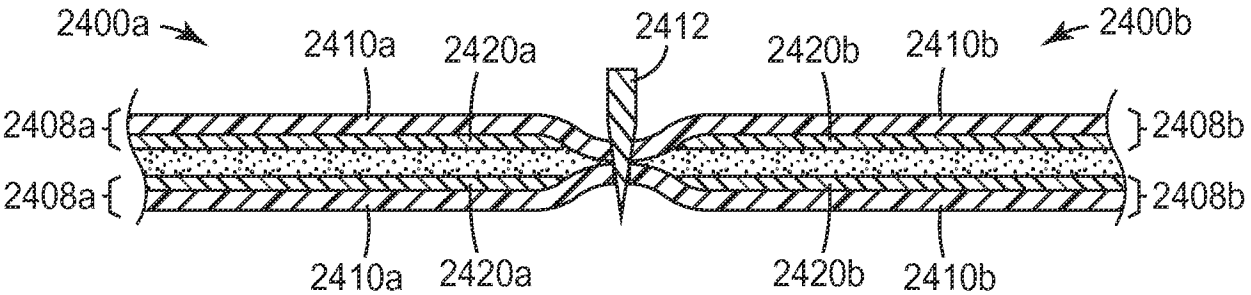

Following the step of stretching the shielding films, cable 2400 is compressed, e.g., by using nip rollers or platens 2455 and optionally heat, e.g., as illustrated in FIG. 24C, bonding substrates 2410 together, e.g., by adhesive layer 2440, in an area corresponding to reservoir 2450. As a result, in this area, longitudinal edges of first and second conductive layers 2420 are recessed relative to longitudinal edges of first and second substrates 2410. In at least one aspect, adhesive layer 2440 flows into openings 2420*c* to encapsulate the longitudinal edges of conductive layers 2420 and provide support to the cable construction in this area. Then, as illustrated in FIG. 24D, shielding films 2408 are slit, e.g., by using a slitting knife 2412, or otherwise separated in an area corresponding to reservoir 2450. As a result, cables 2400*a* and 2400*b* are formed, wherein cable 2400*a* includes the resulting shielding films 2408*a* including first and second substrates 2410*a* and first and second conductive layers 2420*a*, and wherein cable 1800*b* includes the resulting shielding films 2408*b* including first and second substrates 2410*b* and first and second conductive layers 2420*b*. In each cable, longitudinal edges of the first and second conductive layers are recessed relative to longitudinal edges of the first and second substrates, e.g., as illustrated in FIG. 24D. In at least one embodiment, the longitudinal edges of the first and second conductive layers are rougher than the longitudinal edges of the first and second substrates. In at least one aspect, this is the case because the longitudinal edges of the conductive layers are formed by breaking or tearing while stretching the shielding films, while the longitudinal edges of the substrates are formed by slitting.

A first embodiment is an edge insulated electrical cable comprising an electrical cable having a conductive material disposed near a location at a longitudinal edge of the electrical cable and susceptible to making electrical contact at the location; and an insulating material bonded to the electrical cable at the location.

A second embodiment is the edge insulated electrical cable of the first embodiment, wherein the insulating material comprises material used in the electrical cable's construction.

A third embodiment is the edge insulated electrical cable of the first embodiment, wherein the insulating material comprises a thermoplastic material.

A fourth embodiment is the edge insulated electrical cable of the first embodiment, wherein the insulating material comprises a curable compound.

A fifth embodiment is the edge insulated electrical cable of the first embodiment, further comprising a conductive material covering the edge at the location and the insulating material covering the conductive material.

A sixth embodiment is an electrical cable comprising a conductor extending lengthwise along the cable; and a reservoir extending lengthwise along the cable at a first lateral location in the cable, wherein the reservoir contains a dielectric material adapted to be transferred to a different second lateral location in the cable.

A seventh embodiment is the electrical cable of the sixth embodiment, wherein the second lateral location is at a longitudinal edge of the cable.

An eighth embodiment is the electrical cable of the sixth embodiment, further comprising an edge insulation structure formed at the reservoir, wherein the reservoir comprises an insulation layer, wherein the edge insulation structured is formed partially by a portion of the insulation layer of the reservoir.

A ninth embodiment is an edge insulated electrical cable comprising an electrical cable having a conductive material disposed near a longitudinal edge and susceptible to making electrical contact at the edge, wherein the cable is folded along the length of the cable, the fold defining a first portion facing a second portion, the second portion comprising the longitudinal edge of the cable, and a bonding material bonding the second portion to the first portion along the length of the cable.

A tenth embodiment is the edge insulated electrical cable of the ninth embodiment, wherein the bonding material covers the longitudinal edge.

An eleventh embodiment is the edge insulated electrical cable of the ninth embodiment, wherein the electrical cable comprises a film comprising the insulating material.

A twelfth embodiment is an edge insulated electrical cable comprising an electrical cable having a first layer and a second layer, the second layer having a conductive material disposed near a longitudinal edge of the second layer and susceptible to making electrical contact at the edge, wherein the second layer is folded along the length of the cable toward the first layer, the fold defining a first portion of the second layer facing a second portion of the second layer, the second portion of the second layer comprising the longitudinal edge of the second layer, and a bonding material bonding the second portion of the second layer to the first portion of the second layer along the length of the cable.

A thirteenth embodiment is the edge insulated electrical cable of the twelfth embodiment, wherein the bonding material comprises material used in the electrical cable's construction.

A fourteenth embodiment is a method of applying an insulating material to a longitudinal edge of an electrical cable, comprising dispensing the insulating material to at least one of a top and bottom surfaces of the electrical cable proximate and along the longitudinal edge; allowing the insulating material to flow over the longitudinal edge; and preventing a further flow of the insulating material.

A fifteenth embodiment is the method of the fourteenth embodiment, wherein the preventing step comprises solidifying the insulation material.

A sixteenth embodiment is the method of the fifteenth embodiment, wherein the preventing step comprises curing the insulation material.

A seventeenth embodiment is an apparatus for film edge coating, comprising a die assembly configured to dispense a material through a die tip, and an edge of a film positioned proximate the die tip, wherein the die assembly dispenses the material to at least one of a top and bottom surfaces of the film proximate and along the edge of the film, the dispensed material forming a coated region on the film, the coated region being limited to near the edge of the film.

An eighteenth embodiment is the apparatus of the seventeenth embodiment, wherein the film is an electrical cable.

A nineteenth embodiment is the apparatus of the seventeenth embodiment, wherein the die tip includes a dispensing opening allowing the material to exit from the die tip.

A twentieth embodiment is a cable comprising one or more conductor sets, each conductor set extending along a length of the cable and comprising one or more insulated conductors, each insulated conductor comprising a central conductor surrounded by a dielectric material; one or more dielectric unitary blocks, each unitary block extending along the length of the cable; first and second conductive shielding films disposed on opposite first and second sides of the conductor sets and the dielectric blocks, the first and second conductive shielding films including cover portions and pinched portions arranged such that, in cross-section, the cover portions of the first and second shielding films in combination substantially surround each conductor set and each unitary block, and the pinched portions of the first and second shielding films in combination form pinched portions of the cable on each side of the conductor set and on at least one side of the unitary block; and an adhesive layer bonding the first shielding film to the second shielding film in the pinched portions of the cable.

A twenty-first embodiment is the cable of the twentieth embodiment, wherein the unitary block covers at least a portion of a longitudinal edge of at least one of the first and second conductive shielding films.

A twenty-second embodiment is the cable of the twentieth embodiment, wherein the adhesive layer covers at least a portion of a longitudinal edge of at least one of the first and second conductive shielding films.

A twenty-third embodiment is the cable of the twentieth embodiment, wherein the unitary block has a bilobal cross-section having a thinner middle portion disposed between two thicker lobes.

A twenty-fourth embodiment is the cable of the twentieth embodiment, wherein the unitary block has a thickness of less than 1 mm.

A twenty-fifth embodiment is the cable of the twentieth embodiment, wherein the unitary block has a generally rectilinear cross-section.

A twenty-sixth embodiment is the cable of the twentieth embodiment, wherein the unitary block has a generally curvilinear cross-section.

A twenty-seventh embodiment is a cable comprising one or more conductor sets, each conductor set extending along a length of the cable and comprising one or more insulated conductors, each insulated conductor comprising a central conductor surrounded by a dielectric material; a dielectric unitary block disposed along an edge of the cable and extending along the length of the cable and having a bilobal cross-section having a thinner middle portion disposed between thicker first and second lobes; first and second conductive shielding films disposed on opposite first and second sides of the conductor sets and the unitary block, the first and second conductive shielding films including cover portions and pinched portions arranged such that, in cross-section, the cover portions of the first and second shielding films in combination substantially surround each conductor set and the first lobe of the unitary block, and the pinched portions of the first and second shielding films in combination form pinched portions of the cable on each side of the conductor set and on a side of the first lobe opposite the second lobe, an edge of each of the first and second conductive shielding films being disposed in the thinner middle portion of the unitary block; and an adhesive layer bonding the first shielding film to the second shielding film in the pinched portions of the cable, and the first and second shielding films to the first lobe of the unitary block.

A twenty-eighth embodiment is a cable comprising one or more conductor sets, each conductor set extending along a length of the cable and comprising one or more insulated conductors, each insulated conductor comprising a central conductor surrounded by a dielectric material; one or more reservoirs, each reservoir extending along the length of the cable and being filled with a first dielectric material; first and second conductive shielding films disposed on opposite first and second sides of the conductor sets and the reservoirs, the first and second conductive shielding films including cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir; and an adhesive layer bonding the first shielding film to the second shielding film in the pinched portions of the cable, wherein the first and second shielding films comprise respective first and second conductive layers disposed on respective first and second substrates, the first and second conductive layers facing each other, and wherein in a cover portion corresponding to a reservoir, the first conductive layer, but not the first substrate, comprises an opening extending along at least a portion of the length of the cable.

A twenty-ninth embodiment is the cable of the twenty-eighth embodiment, wherein the first dielectric material comprises an adhesive.

A thirtieth embodiment is a cable comprising one or more conductor sets, each conductor set extending along a length of the cable and comprising one or more insulated conductors, each insulated conductor comprising a central conductor surrounded by a dielectric material; one or more reservoirs, each reservoir extending along the length of the cable and being filled with a first dielectric material; first and second conductive shielding films disposed on opposite first and second sides of the conductor sets and the reservoirs, the first and second conductive shielding films including cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir; and an adhesive layer bonding the first shielding film to the second shielding film in the pinched portions of the cable, wherein the first and second shielding films comprise respective first and second conductive layers disposed on respective first and second substrates, the first and second conductive layers facing each other, and wherein in a cover portion corresponding to a reservoir, longitudinal edges of the first and second conductive layers are recessed relative to longitudinal edges of the first and second substrates.

A thirty-first embodiment is the cable of the thirtieth embodiment, wherein the longitudinal edges of the first and second conductive layers are rougher than the longitudinal edges of the first and second substrates.

The present invention should not be considered limited to the particular examples and embodiments described above, as such embodiments are described in detail to facilitate explanation of various aspects of the invention. Rather the present invention should be understood to cover all aspects of the invention, including various modifications, equivalent processes, and alternative devices falling within the spirit and scope of the invention as defined by the appended claims.

What is claimed is:

1. A cable comprising: one or more conductor sets, each conductor set extending along a length of the cable and comprising one or more insulated conductors, each insulated conductor comprising a central conductor surrounded by a dielectric material, one or more dielectric unitary blocks, each unitary block disposed at a longitudinal edge of the cable and spaced apart from the insulated conductors of the one or more conductor sets; each unitary block extending along the length of the cable; first and second conductive shielding films disposed on opposite first and second sides of the conductor sets and the dielectric blocks, the first and second conductive shielding films including cover portions and pinched portions arranged such that, in cross-section, the cover portions of the first and second shielding films in combination substantially surround each conductor set and each unitary block, and the pinched portions of the first and second shielding films in combination form pinched portions of the cable on each side of the conductor set and on at least one side of the unitary block; and an adhesive layer bonding the first shielding film to the second shielding film in the pinched portions of the cable.

2. The cable of claim 1, wherein the unitary block covers at least a portion of a longitudinal edge of at least one of the first and second conductive shielding films.

3. The cable of claim 1, wherein the adhesive layer covers at least a portion of a longitudinal edge of at least one of the first and second conductive shielding films.

4. The cable of claim 1, wherein the unitary block has a bilobal cross-section having a thinner middle portion disposed between two thicker lobes.

5. The cable of claim 1, wherein the unitary block has a generally rectilinear cross-section.

6. The cable of claim 1, wherein the unitary block has a generally curvilinear cross-section.

7. A cable comprising:

one or more conductor sets, each conductor set extending along a length of the cable and comprising one or more insulated conductors, each insulated conductor comprising a central conductor surrounded by a dielectric material;

a dielectric unitary block disposed along an edge of the cable and extending along the length of the cable and having a bilobal cross-section having a thinner middle portion disposed between thicker first and second lobes;

first and second conductive shielding films disposed on opposite first and second sides of the conductor sets and the unitary block, the first and second conductive shielding films including cover portions and pinched portions arranged such that, in cross-section, the cover portions of the first and second shielding films in combination substantially surround each conductor set and the first lobe of the unitary block, and the pinched portions of the first and second shielding films in combination form pinched portions of the cable on each side of the conductor set and on a side of the first lobe opposite the second lobe, an edge of each of the first and second conductive shielding films being disposed in the thinner middle portion of the unitary block; and an adhesive layer bonding the first shielding film to the second shielding film in the pinched portions of the cable, and the first and second shielding films to the first lobe of the unitary block.

8. A cable comprising:

one or more conductor sets, each conductor set extending along a length of the cable and comprising one or more insulated conductors, each insulated conductor comprising a central conductor surrounded by a dielectric material;

one or more reservoirs, each reservoir extending along the length of the cable and being filled with a first dielectric material;

first and second conductive shielding films disposed on opposite first and second sides of the conductor sets and the reservoirs, the first and second conductive shielding films including cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir; and an adhesive layer bonding the first shielding film to the second shielding film in the pinched portions of the cable, wherein the first and second shielding films comprise respective first and second conductive layers disposed on respective first and second substrates, the first and second conductive layers facing each other, and wherein in a cover portion corresponding to a reservoir, the first conductive layer, but not the first substrate, comprises an opening extending along at least a portion of the length of the cable, and the first substrate in the cover portion is elongated laterally relative to the first substrate on each side of the cover portion.

9. The cable of claim 8, wherein the first dielectric material comprises an adhesive.

10. A cable comprising:

one or more conductor sets, each conductor set extending along a length of the cable and comprising one or more insulated conductors, each insulated conductor comprising a central conductor surrounded by a dielectric material;

one or more reservoirs, each reservoir extending along the length of the cable and being filled with a first dielectric material;

first and second conductive shielding films disposed on opposite first and second sides of the conductor sets and the reservoirs, the first and second conductive shielding films including cover portions and pinched portions arranged such that, in cross-section, the cover portions of the first and second shielding films in combination substantially surround each conductor set and each reservoir, and the pinched portions of the first and second shielding films in combination form pinched portions of the cable on each side of the conductor set and the reservoir; and an adhesive layer bonding the first shielding film to the second shielding film in the pinched portions of the cable, wherein the first and second shielding films comprise respective first and second conductive layers disposed on respective first and second substrates, the first and second conductive layers facing each other, and wherein in a cover portion corresponding to a reservoir, longitudinal edges of the first and second conductive layers in the cover portion are recessed relative to longitudinal edges of the first and second substrates in the cover portion.

11. The cable of claim 10, wherein the longitudinal edges of the first and second conductive layers are rougher than the longitudinal edges of the first and second substrates.

12. The cable of claim 1, wherein the unitary block has a thickness of less than 1 mm.

* * * * *